US008132489B2

(12) United States Patent
Zieger

(10) Patent No.: US 8,132,489 B2
(45) Date of Patent: Mar. 13, 2012

(54) CLAMPING AND CUTTING APPARATUS FOR CONVEYOR BELTS

(75) Inventor: Andrew J. Zieger, Grand Rapids, MI (US)

(73) Assignee: Flexible Steel Lacing Company, Downers Grove, IL (US)

( * ) Notice: Subject to any disclaimer, the term of this patent is extended or adjusted under 35 U.S.C. 154(b) by 674 days.

(21) Appl. No.: 12/167,948

(22) Filed: Jul. 3, 2008

(65) Prior Publication Data

US 2009/0007741 A1 Jan. 8, 2009

Related U.S. Application Data

(60) Provisional application No. 60/947,845, filed on Jul. 3, 2007.

(51) Int. Cl.
*B26D 7/02* (2006.01)
*B25B 1/20* (2006.01)

(52) U.S. Cl. ..... 83/455; 83/464; 269/43; 269/93

(58) Field of Classification Search ..... 83/458, 83/464, 462, 614, 631, 454, 456, 457, 459, 83/460, 455; 269/43, 93, 95, 166
See application file for complete search history.

(56) References Cited

U.S. PATENT DOCUMENTS

| | | | | |
|---|---|---|---|---|
| 1,344,169 | A | 6/1920 | Buckingham | |
| 1,415,355 | A | 5/1922 | Jacobs et al. | |
| 1,805,163 | A | 5/1931 | Buckner | |
| 1,897,534 | A * | 2/1933 | Simpson | 83/374 |
| 2,726,694 | A * | 12/1955 | Saxton | 269/218 |
| 3,588,994 | A * | 6/1971 | Parenti | 29/243.51 |
| 5,018,262 | A | 5/1991 | Wheatcroft | |
| 5,020,209 | A | 6/1991 | Fullard | |
| D328,749 | S * | 8/1992 | Womack | D15/127 |
| 2007/0271754 | A1 | 11/2007 | Kolodziej | |

* cited by examiner

*Primary Examiner* — Stephen Choi
(74) *Attorney, Agent, or Firm* — Fitch Even Tabin & Flannery

(57) ABSTRACT

A clamping and cutting apparatus for a conveyor belt is provided. The apparatus includes upper and lower elongate members between which the belt is to be clamped. A clamping mechanism has a screw drive mechanism mounted to the upper member and an end linkage assembly which are operable to generate a more rapid clamping operation of the elongate members on the belt. The upper elongate member can be releasably latched to the lower elongate member for quick connection and removal therefrom. A cutting blade of the apparatus is preferably provided with upper and lower guides to increase the rigidity thereof for increasing cutting accuracy and allowing thicker belts to be cut therewith without increasing blade thickness.

14 Claims, 29 Drawing Sheets

| Theoretical - 100% Efficient | |
|---|---|
| Torque on Handle | Load on Blade |
| 2.5 | 49.425 |
| 5 | 98.85 |
| 7.5 | 148.275 |
| 10 | 197.7 |

Fig. 33

Fig. 34

| New Flexco 840 Belt Cutter | | | | | | | | |
|---|---|---|---|---|---|---|---|---|
| Torque on Handle | Load on Blade - Indirect Pull | | | | Load on Blade - Direct Pull | | | |
| | Trial 1 | Trial 2 | Trial 3 | Average | Trial 1 | Trial 2 | Trial 3 | Average |
| 5 | 23 | 21 | 19 | 21.0 | 35 | 48 | 48 | 43.7 |
| 10 | 45 | 45 | 54 | 48.0 | 75 | 97 | 95 | 89.0 |
| 15 | 78 | 75 | 82 | 78.3 | 116 | 146 | 140 | 134.0 |
| 20 | 108 | 104 | 107 | 106.3 | 160 | 187 | 182 | 176.3 |
| 25 | 132 | 121 | 132 | 128.3 | 212 | 215 | 215 | 214.0 |
| 30 | 174 | 162 | 178 | 171.3 | | | | |
| 35 | 198 | 199 | 199 | 198.7 | | | | |

Fig. 35

| Premium Cutter Prototype Rav10 w/ Ball Bearings and 4" UHMW Guide Block | | | | | | | | |
|---|---|---|---|---|---|---|---|---|
| Torque on Handle | Load on Blade - Indirect Pull | | | | Load on Blade - Direct Pull | | | |
| | Trial 1 | Trial 2 | Trial 3 | Average | Trial 1 | Trial 2 | Trial 3 | Average |
| 2.5 | 42 | 45 | 43 | 43.3 | 47 | 48 | 48 | 47.7 |
| 5 | 81 | 82 | 79 | 80.7 | 81 | 81 | 82 | 81.3 |
| 7.5 | 121 | 121 | 119 | 120.3 | 128 | 125 | 125 | 126.0 |
| 10 | 161 | 161 | 159 | 160.3 | 162 | 160 | 163 | 161.7 |
| 12.5 | 198 | 199 | 199 | 198.7 | 202 | 201 | 202 | 201.7 |

Fig. 36

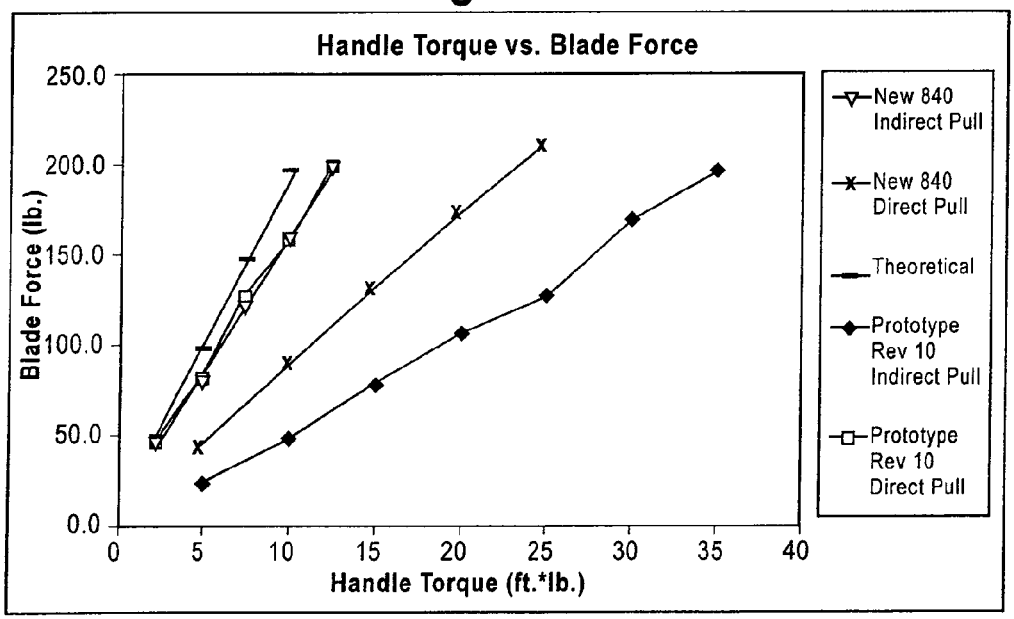

CLAMPING AND CUTTING APPARATUS FOR CONVEYOR BELTS

FIELD OF THE INVENTION

The invention relates to an apparatus for cutting conveyor belts, and more particularly, an apparatus that clamps across the width of a conveyor belt and cuts the conveyor belt therealong.

BACKGROUND OF THE INVENTION

For forming a belt splice, typically a conveyor belt is cut across its width at two locations to form squared ends of the belt that are then joined or spliced together with mechanical fasteners. Applicant's assignee herein has a belt cutter (the "840 Series Belt Cutter") that has a long clamp bar with a pair of spring loaded, clamping mechanisms that clamp the conveyor belt between the clamp bar and a long base member. Thereafter, a cutting handle is operated to drive a cutting blade through the belt from one side of the belt to the other. In this belt cutter, the clamp bar has an inverted U-shaped configuration with opposite legs of the clamp bar clamping on the conveyor belt on either side of cutting blade. It has been found that this clamping arrangement on either side of the cutting blade requires that an operator apply an unduly large amount of torque on the drive handle for driving the cutting blade through the belt.

The applicant's assignee's prior belt cutting apparatus had the pair of spring loaded clamping mechanisms associated with the clamp bar at locations approximately midway between the center of the long clamp bar and the adjacent clamp bar end. The positioning of the clamp mechanisms closer to the center of the clamp bar is in an effort to minimize deflection of the clamp bar at the center portion thereof during clamping. These spring loaded clamping mechanisms generate concentrated clamping forces between the clamp bar and base member on the conveyor belt at the locations under the clamping mechanisms. Since the long clamp bar member extends well beyond the clamping mechanisms, these outer portions of the long, clamp member tend to bow upwardly with application of the high clamping forces to the conveyor belt. Further, since these clamping mechanisms employed compression springs, it has been found to be difficult to maintain a constant clamp force therewith as belt thicknesses vary. Although other belt cutters have employed direct drive-type screw clamping mechanisms to better control the clamp force, these belt cutters required that an operator take too much time to turn the screw mechanisms to drive the clamp bar down into secure, clamping engagement with the conveyor belt to be cut, especially for relatively thin conveyor belts.

Accordingly, there is a need for a cutting apparatus for a conveyor belt that more efficiently transmits applied torque from the cutting blade drive handle to the cutting blade for easier cutting of a conveyor belt. Further, a conveyor belt cutting apparatus that has improved control over clamping forces for clamping on varying thicknesses of conveyor belts and that more quickly clamps on a belt would be desirable.

SUMMARY OF THE INVENTION

In accordance with one aspect of the invention, a belt clamping and cutting apparatus is provided that has a more rapid clamping operation while still generating sufficiently high clamping forces for clamping a conveyor belt with upper and lower elongate members with the clamped belt then cut thereacross. In the preferred belt cutting and clamping apparatus, an end linkage assembly forms pivot connections that are outboard and inboard relative to the upper elongate member with a drive shaft of a screw drive mechanism therebetween. In this manner, the screw drive mechanism is not a direct drive-type screw drive as in prior belt cutting devices and the end linkage assembly generates much faster clamping operation with turning of the screw drive shaft.

Preferably, at least one pivot link member is between the inboard and outboard pivot connections with the screw drive shaft pivotably connected to the link at an intermediate location between the inboard and outboard pivot connections. In one form, the intermediate pivot connection is approximately midway between the inboard and outboard pivot connections so that a doubling of the rate of downward travel of the upper elongate member is achieved with turning of the screw drive shaft.

In another aspect, the upper and lower elongate members have at least one latching mechanism at an end thereof to allow for both easy and quick connection of the upper member to the lower member and removal therefrom. Preferably, the latching mechanism is provided at both ends of the elongate members. In addition, the latching mechanism preferably includes a latch pin carried by at least one link member of the end linkage assembly and which forms an outboard, anchored pivot connection in cooperation with a biased latch member operatively mounted to the lower elongate member.

BRIEF DESCRIPTION OF THE DRAWINGS

FIGS. 33-36 are charts of test data and a graph of the data regarding the torque applied to the drive handle for the cutting blade assembly and the resulting load on the cutting blade for the prior belt cutting apparatus and the belt cutting apparatus of the present invention.

DETAILED DESCRIPTION OF THE PREFERRED EMBODIMENTS

Figure 1:
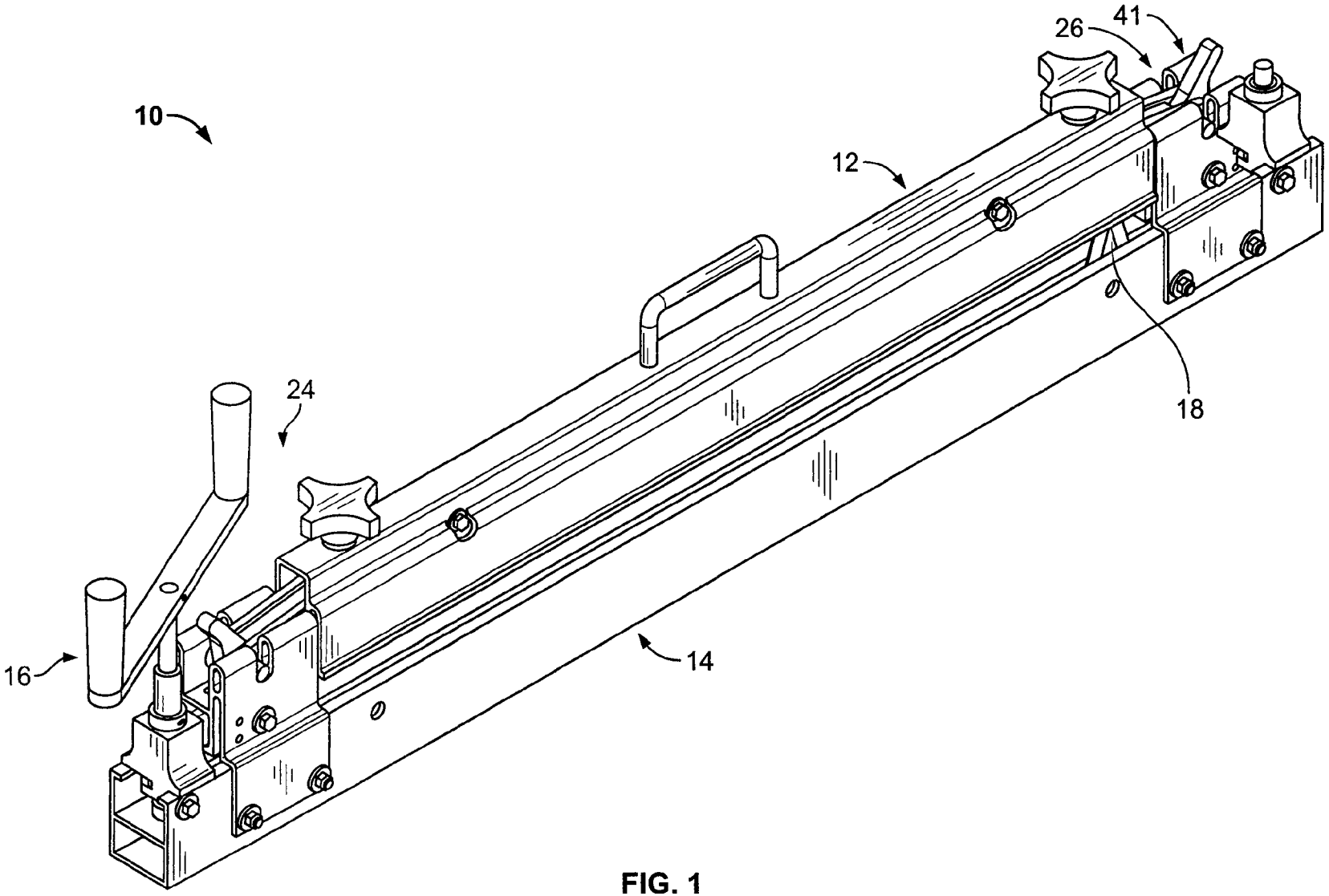
FIG. 1 is a perspective view of a clamping and cutting apparatus for a conveyor belt showing an upper, long clamp beam and a lower, long base member between which a conveyor belt is clamped.

In FIG. 1, a belt clamping and cutting apparatus 10 that is operable to clamp a conveyor belt 23 and cut the conveyor belt across its width is shown. An alternative belt clamping and cutting apparatus 10' (FIG. 22) is shown in FIGS. 22-31. The apparatus 10' has its components all designated with primed reference numerals with similar components to those of apparatus 10 being designated with the same reference numeral except with a prime added thereto.

The belt cutting apparatus 10 has a long, upper clamp beam 12 (FIGS. 10-12) and an even longer, lower base member 14 (FIG. 21) between which the conveyor belt is clamped. The belt cutting apparatus 10 herein more efficiently transmits the torque applied to a drive handle 16 to a cutting blade 18 for driving the cutting blade 18 through the clamped conveyor belt so that the belt cutting apparatus 10 herein is much easier to operate than, for example, Applicant's assignee's prior belt cutter. In this regard, the upper clamp beam 12 clamps down on the conveyor belt along only a single side of the cutting blade 18 so that as the cutting blade 18 is driven through the belt the cut belt peels away from the cutting blade 18. In addition, the cutting blade assembly 20 has optimized features in terms of the size and the driving of the cutting blade 18 that provide for a smoother and more efficient cutting action therewith. A chain 21 of blade chain drive mechanism 22 is also connected to the cutting blade assembly 20 to avoid generating moments in the cutting blade assembly 20 that would otherwise tend to create drag during a cutting operation with belt cutting apparatus 10 herein.

Another advantage provided by the belt cutting apparatus 10 is a faster clamping operation provided by clamping mechanisms 24 and 26 at either end of the belt cutting apparatus 10 over prior screw clamp mechanisms. Further, the camber or upward curvature provided to the long, lower base member 14, as seen best in FIG. 2, along with having the locations of the clamping mechanisms 24 and 26 closer to the corresponding ends of the upper clamp beam 12 are effective to more evenly spread the clamping forces across the width of the conveyor belt with a conveyor belt clamped between the upper and lower members 12 and 14.

Figure 3:
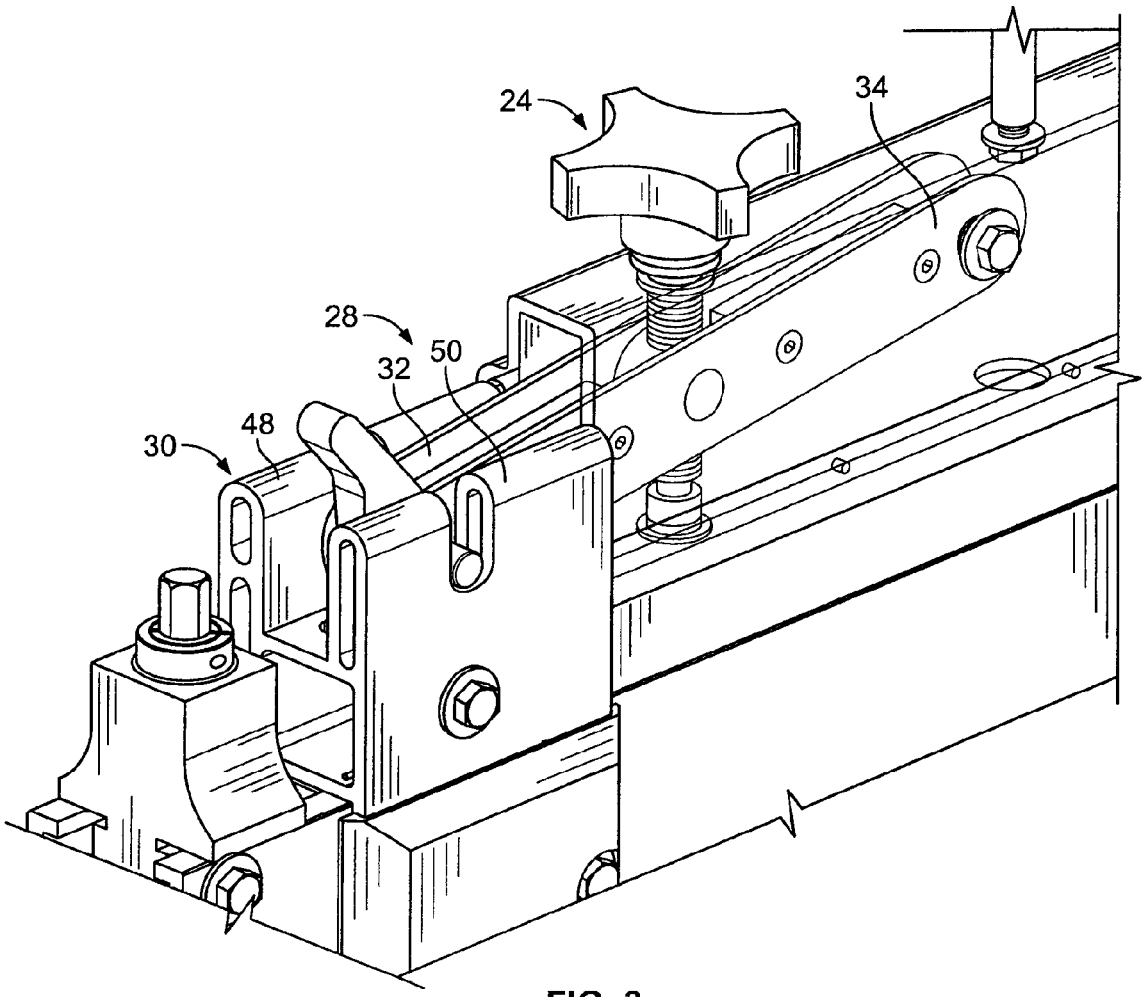
FIG. 3 is an enlarged, perspective view of one end of the cutting apparatus with a clamp bar in ghost to show a clamping mechanism at one end of the clamp bar.
Figure 4:
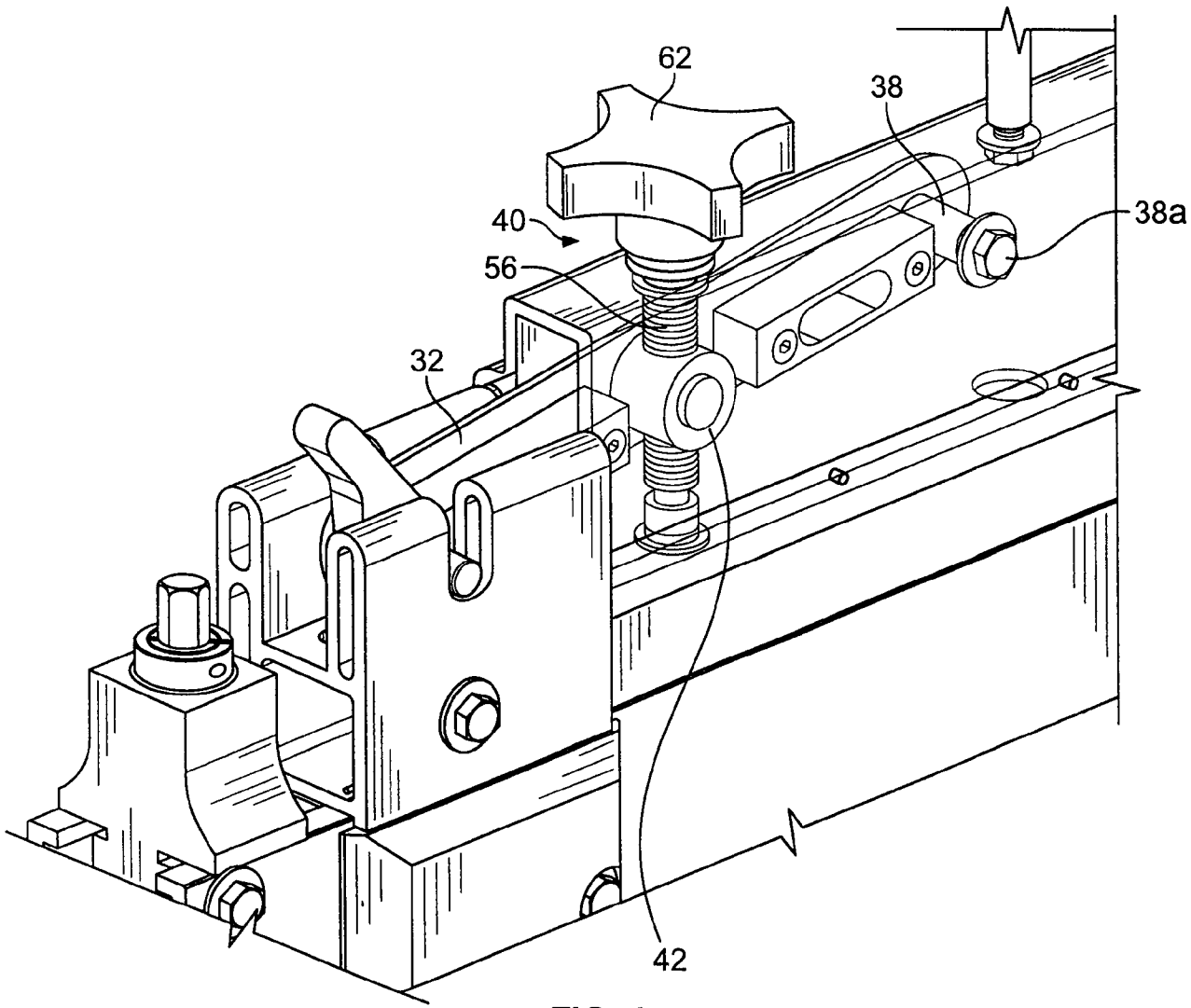
FIG. 4 is a view similar to FIG. 3 with one of a pair of link members removed to show a screw drive for the clamping mechanism.
Figure 5:
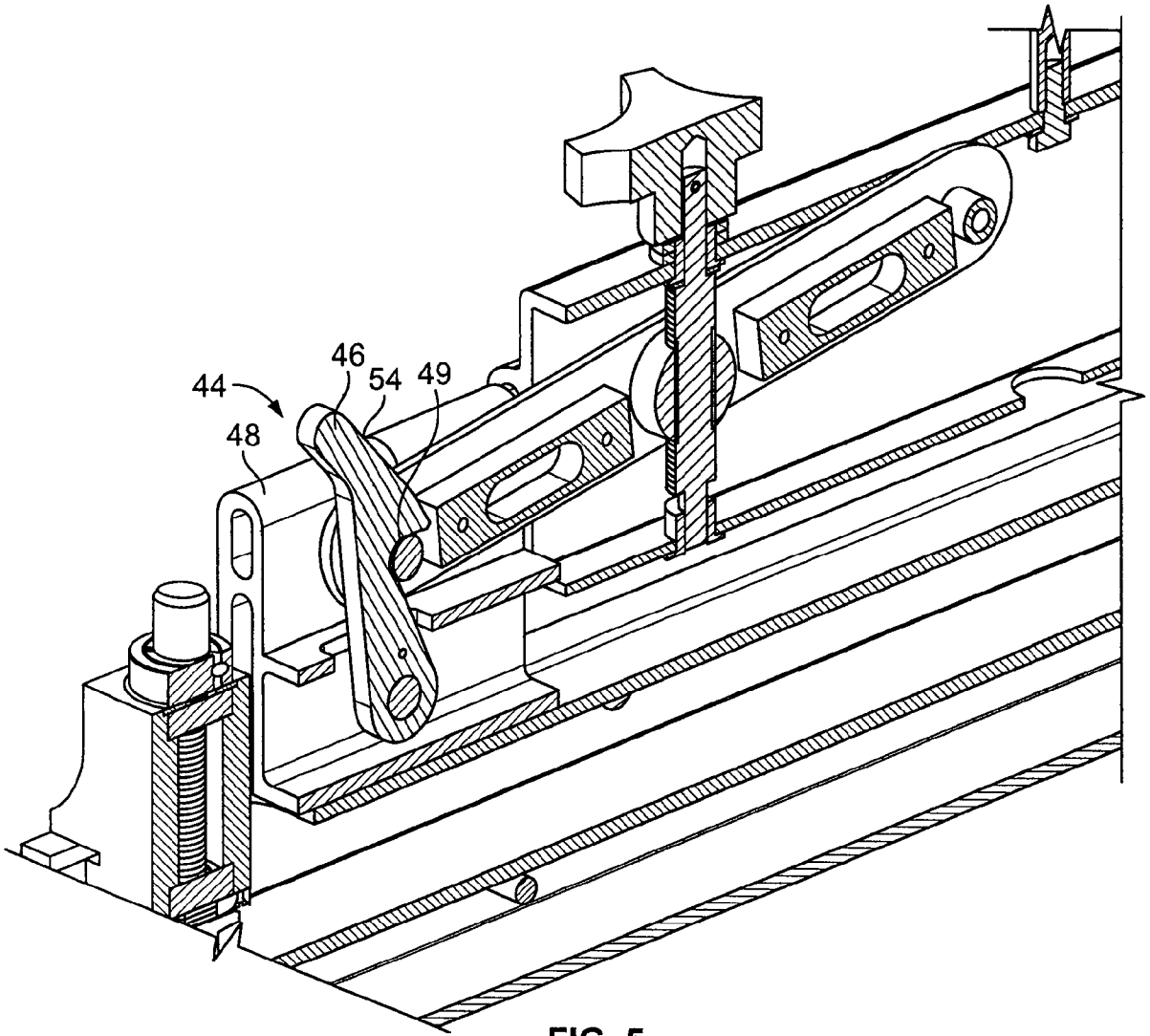
FIG. 5 is a sectional view similar to FIG. 4 showing a latching mechanism for releasably connecting the clamp beam to an upright member secured to the base member.
Figure 24:
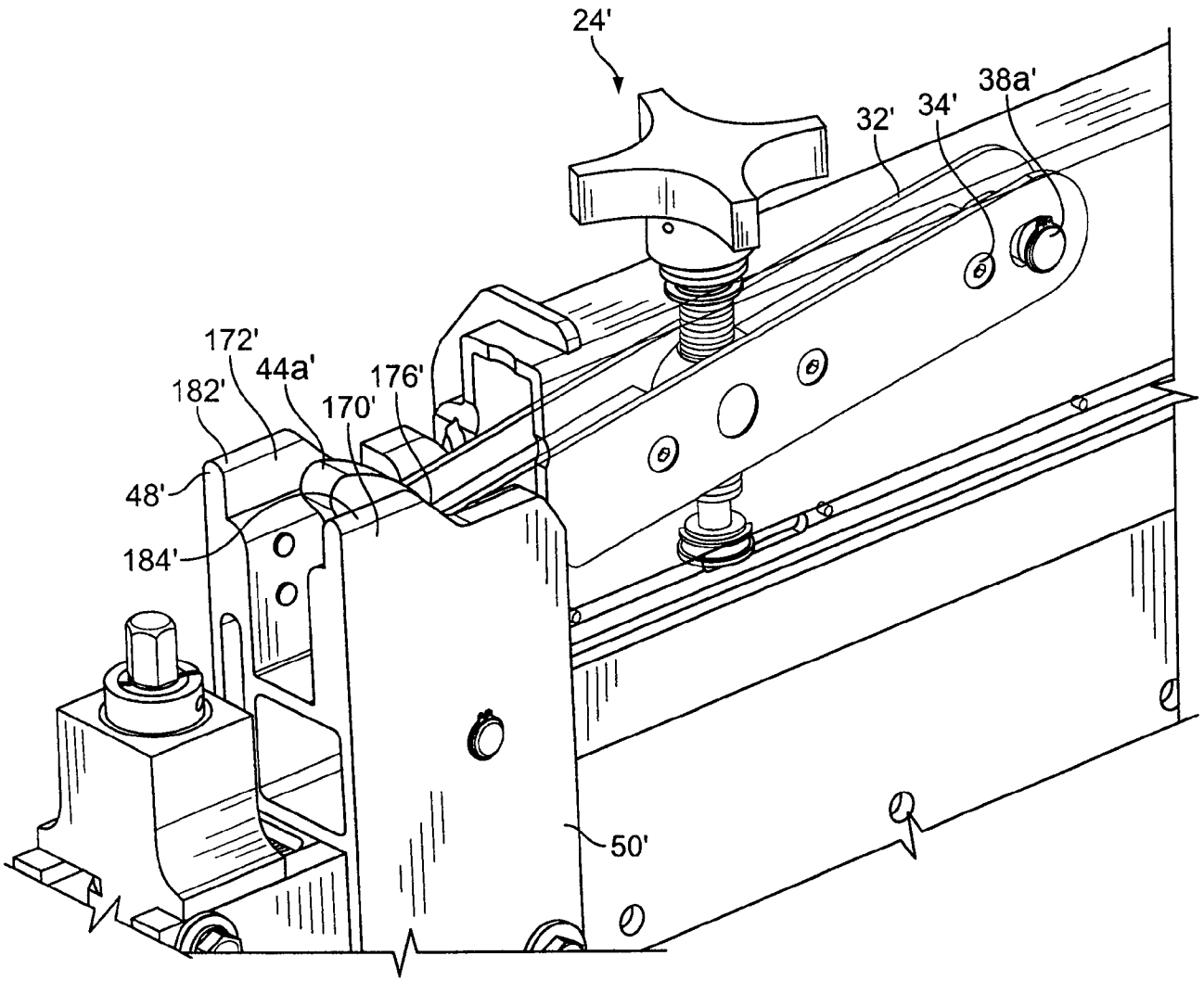

In the belt clamping apparatus 10, the clamping mechanisms 24 and 26 are of a mirror image construction so that only clamping mechanism 24 will be described herein. For controlling the speed of clamping and the amount of clamping force applied by the clamping mechanism 24, an end linkage assembly 28 is provided as shown in FIGS. 3-5. The end linkage assembly 28 is connected at its upper, inboard end to the upper clamp beam 12 and at its lower, outboard end it is releasably latched to an end upright member 30 (FIG. 20) that is secured thereto adjacent the corresponding end thereof. The end linkage assembly 28 includes a pair of link members 32 and 34 that extend at an angle upwardly into the main, long box shaped portion 36 of the upper clamp beam 12 (FIG. 6) and are pivotally secured thereto via pivot shaft 38. The pivot shaft 38 has a threaded bore for receiving threaded bolts 38*a* therein. Alternatively, the pivot shaft 38' can be secured to the clamp beam 12' by external annular clips 38*a*', as shown in FIG. 24 for clamping apparatus 10'.

Figure 6:
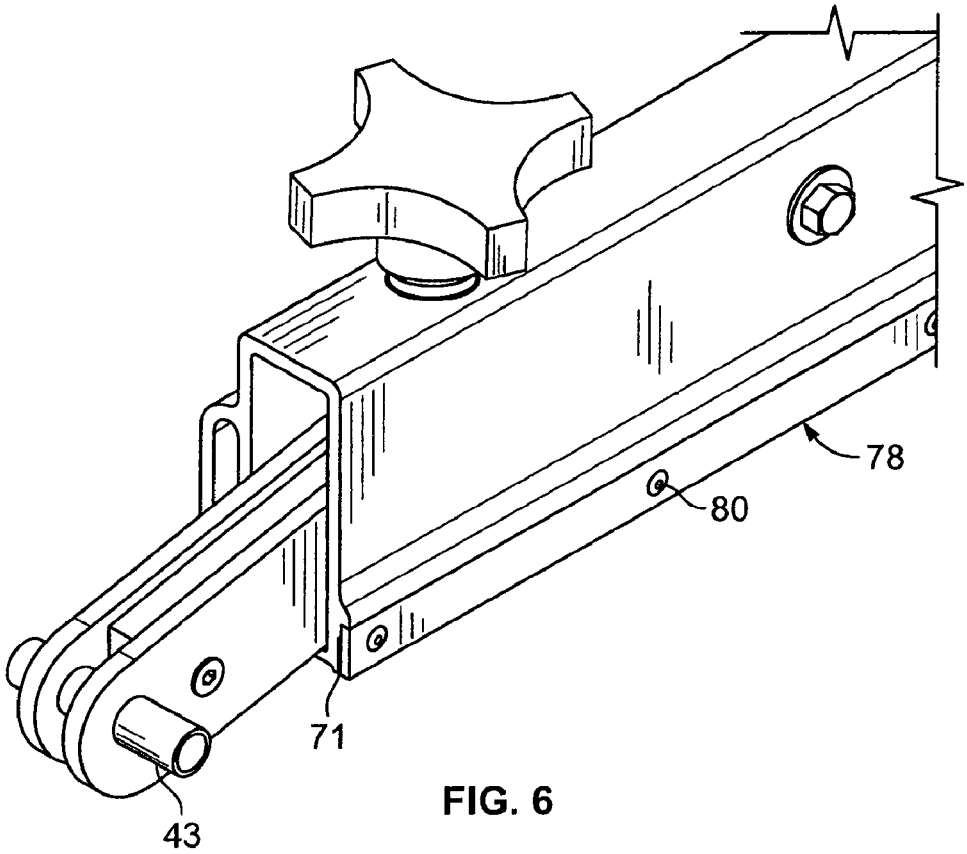
FIG. 6 is a perspective view of a latch pin at the end of the link members projecting out from the clamp beam.
Figure 7A:
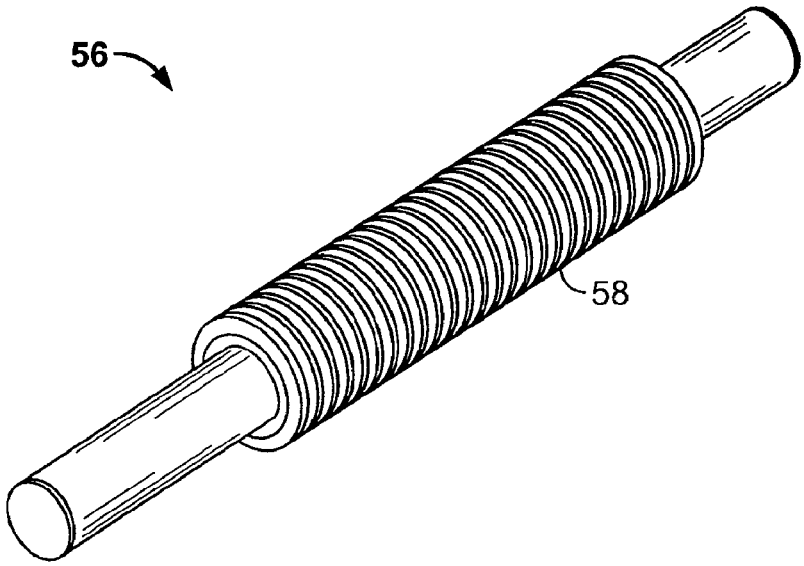
FIGS. 7A and 7B are views of the screw of the screw drive mechanism.
Figure 7B:
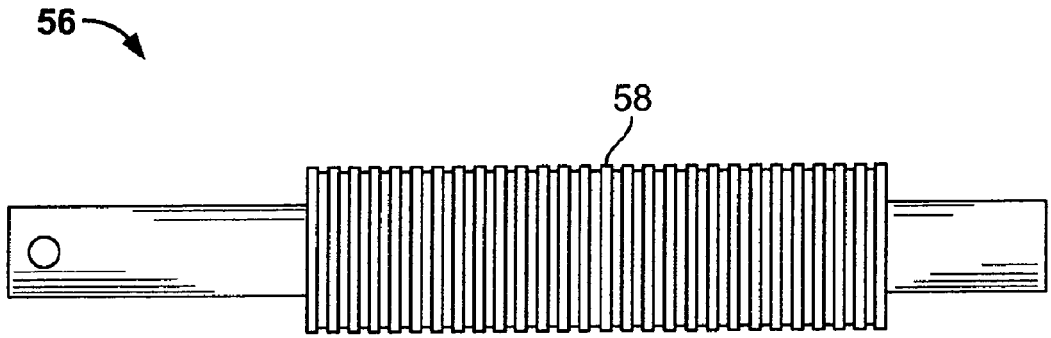
Figure 8:
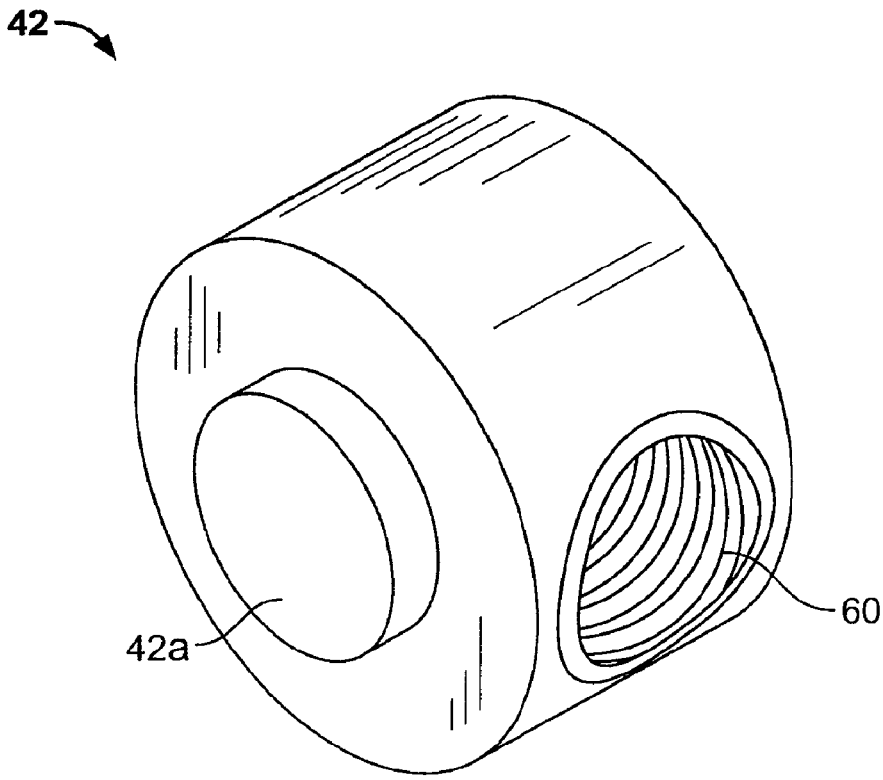
FIGS. 8 and 9 are views of the internally threaded nut of the screw drive mechanism.
Figure 9:
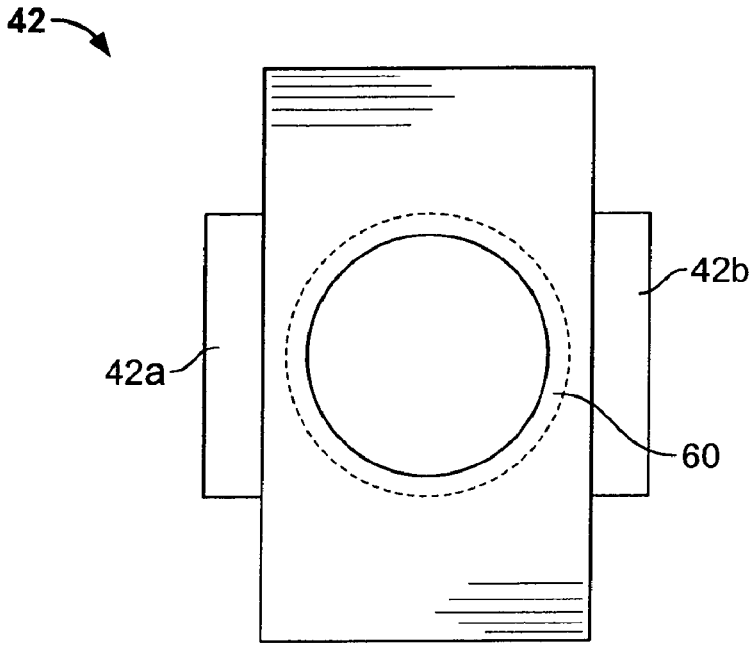

A screw drive mechanism 40 of the clamping mechanism 24 has an internally threaded nut 42 (FIGS. 8 and 9) between the link members 32 and 34 at a fixed intermediate position along their lengths with the link members 32 and 34 being rotatable about the nut 42. At their outboard ends, extending at an angle downwardly out from the box shaped portion 36 of the upper clamping beam 12, the link member 32 and 34 carry a latch pin 43, as shown in FIG. 6. In this manner, the link members 32 and 34 as shown in FIG. 5 extend at an incline from an upper, inboard position where they are secured to the upper clamp beam 12 for pivoting relative thereto to a lower, outboard position at which they are latched to the end upright member 30 in the fully open position of the clamp beam 12 and base 14 for receiving a belt to be clamped therebetween.

The internally threaded nut 42 has a disc shape and includes a pair of central, side pivot bosses 42*a* and 42*b* for pivotally being received in corresponding openings formed generally midway along the lengths of the parallel link members 32 and 34. Accordingly, the link members 32 and 34 can rotate about the bosses 42*a* and 42*b* when the upper clamp beam 12 is latched to the upright member 30 and the clamping mechanism 24 is operated to drive the clamp beam 12 downward with the nut 42 traveling upward in the clamp beam portion 36, as will be discussed further hereinafter.

Figure 25:
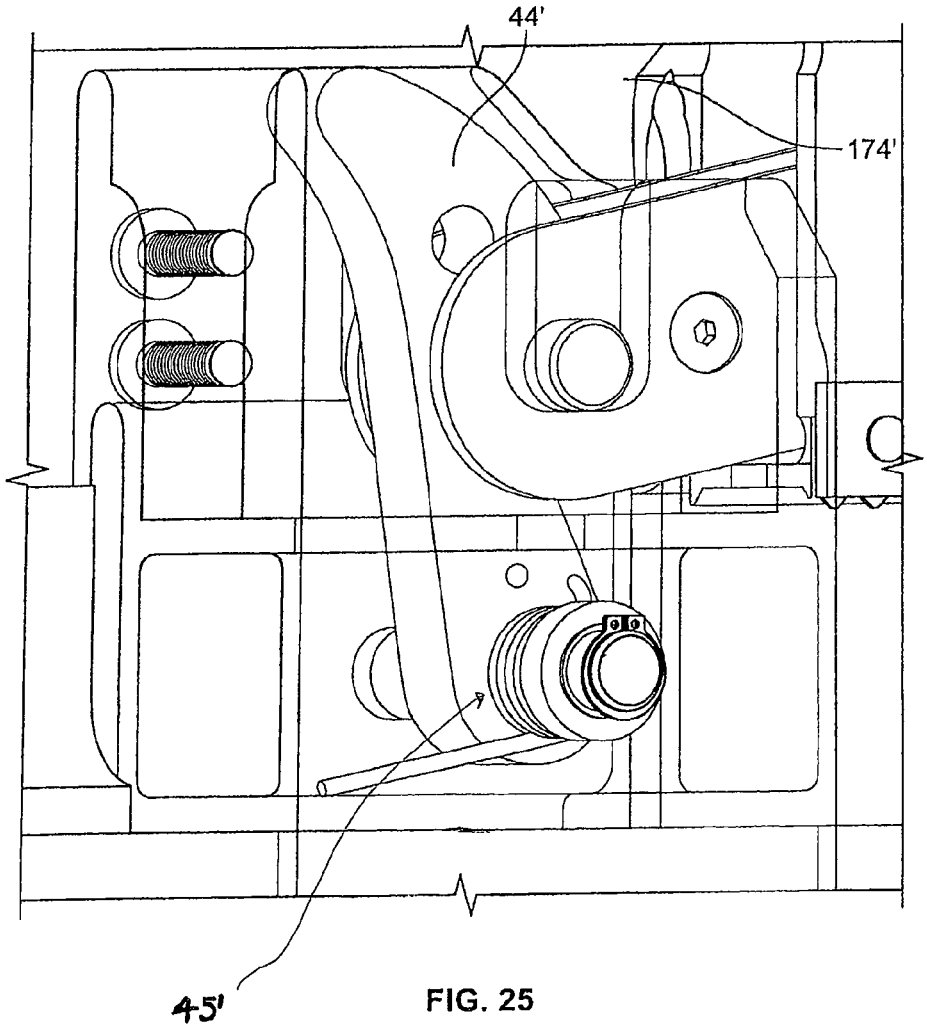
Figure 26:
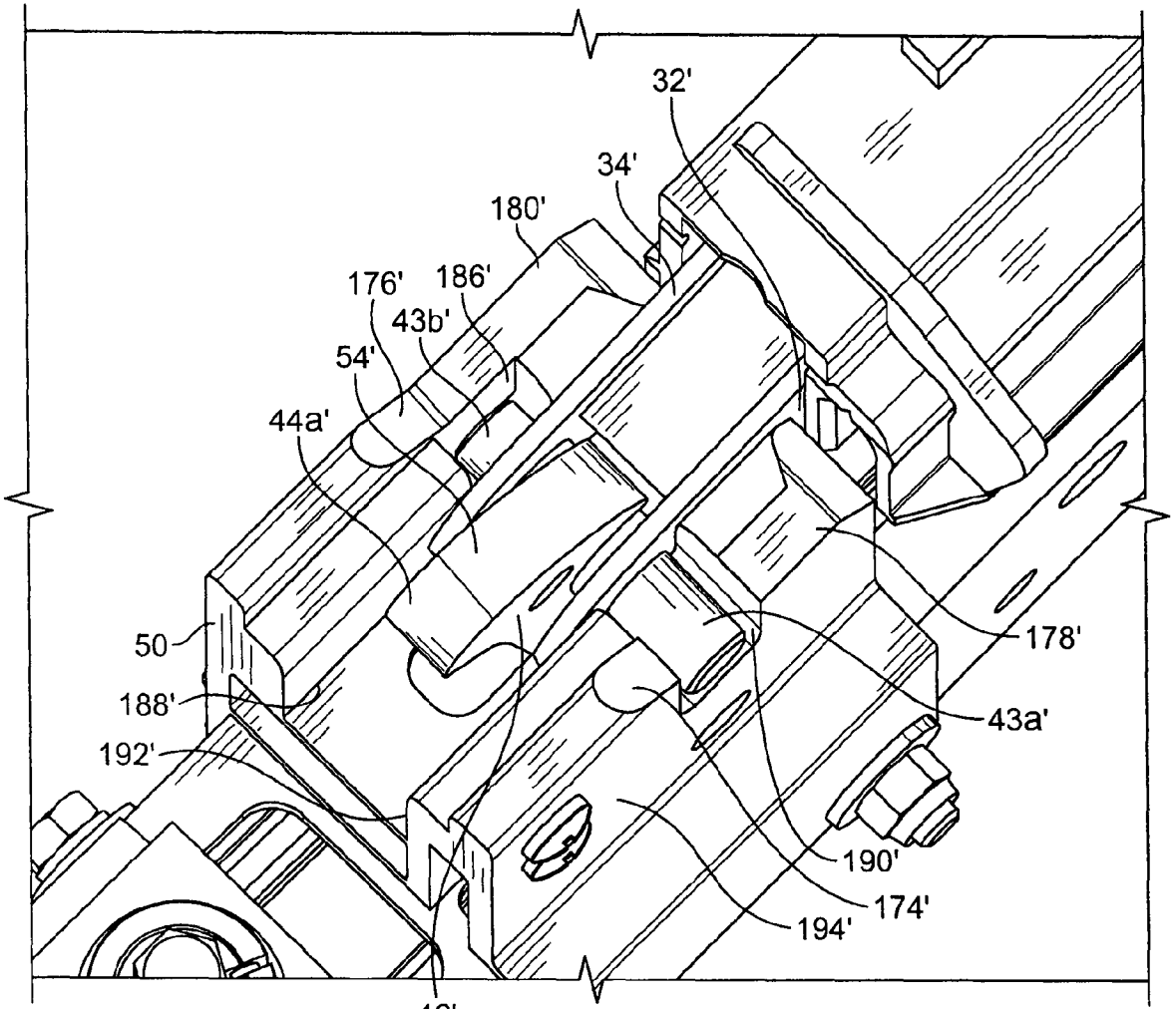

Referring more specifically to FIG. 5, a spring loaded latch member 44 is pivotally connected to the end upright member 30 at its lower end, such as via a torsion spring 45' shown in FIG. 25 for latch member 44' of alternative apparatus 10'. The upper, latch portion 46 of the latch member 44 extends upwardly between two side upright wall portions 48 and 50 of the end upright member 30 and is spring biased to the latched position shown in FIGS. 1 and 3-5. The latch portion 46 includes a downwardly facing notch 49 which receives the latch pin 43 as shown for releasably connecting the upper clamp beam 12 to the end upright member 30 and thus to the remainder of belt cutting apparatus 10 including the lower base member 14 thereof. A similar releasable connection or latching mechanism 41 is provided at the other end of the belt cutting apparatus 10, as can be seen in FIG. 1.

The upper latch portion 46 has an inclined cam surface 54 that extends obliquely to the vertical or clamping direction which allows the clamp beam 12 to be quickly connected to the belt cutting apparatus 10 simply by engaging the portion of the latch pin 43 that extends between the link members 32 and 34 against the cam surface 54 and directing the clamp beam 12 downward so that the pin 43 pushes against the cam surface 54 causing the latch member 44 to pivot outwardly against its spring bias. In this manner, the latch pin 43 serves as a latch actuator for releasably latching the clamp beam 12 to the lower base member 14. Once the latch pin 43 clears the lower end of the cam surface 54, the latch pin 43 will be received in the notch 49 with the latch member 44 being spring loaded back to its latched position, as shown in FIG. 5.

With the pin 43 so latched, a pivotal anchored connection is formed between the clamp beam 12 and the lower base member 14. To lift the clamping beam 12 off the belt cutting apparatus 10, an operator simply pushes against the upper portion of the cam surface 54 projecting beyond the side upright portions 48 and 50 of the end member 30 down into the space therebetween until the lower end of the cam surface 54 is in clearance with the latch pin 43. Thereafter, the upper clamping 12 can be lifted off the corresponding end of the belt cutting apparatus 10.

In belt cutting apparatus 10', the end upright members 30' are modified to keep the latch members 44' and specifically the upper, latch portions 46 thereof from being accidentally engaged and shifted from their latched positions with the upper clamp member or beam 12' releasably latched to the lower base member 14' to their release positions. For this purpose, the side wall portions 48' and 50' of the end upright members 30' are sized relative to the latch members 44' mounted to the end upright members 30' and biased to their latched positions so that the latch members 44' do not project upwardly beyond the adjacent side wall portions 48' and 50' on either side of the respective latch members 44', as can be seen in FIGS. 22-26.

Figure 23:
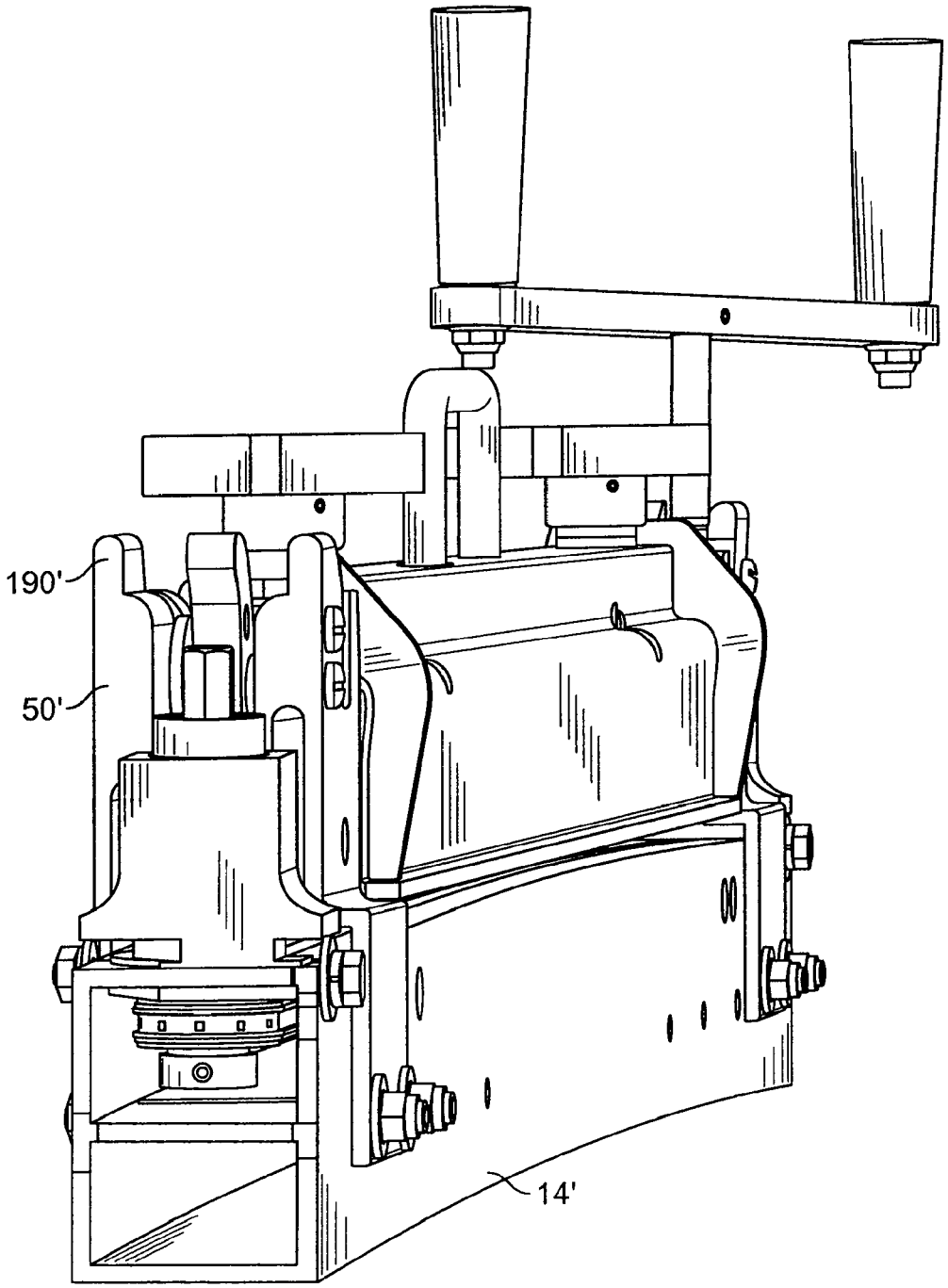

More specifically, it can be seen that with the latch member 44' in the latched position, top end 44*a*' of the latch member 44' does not project upwardly beyond upper, outboard extension portions 170' and 172' of the respective side wall portions 48' and 50', as best seen in FIGS. 23 and 24. The side wall portions 48' and 50' each have an inclined surface 174' and 176' generally aligned across the end upright member 30' from the inclined cam surface 54' of the latch member upper portion 46'. Upper, inboard surfaces 178' and 180' of the side wall portions 48' and 50' extend generally horizontally and are lower relative to the uppermost horizontally extending surfaces 182' and 184' of the extension portions 170' and 172' but are inboard of the latched pin 43' and the latch member upper portion 46'. Accordingly, the only way to actuate the latch member 44' to pivot it to the release position is to insert an object or operator's finger between the raised extension portions 170' and 172' of the side walls 48' and 50' to engage and push the cam surface 54' of the latch member 44'. In this manner, instances of accidental release of the latched connection between the upper clamp beam 12' and lower base member 14' should be reduced.

To avoid having the upper clamp beam 12' latched to the lower base member 14' in a reverse orientation, which would lead to improper operation of the cutting blade 18' as discussed further hereinafter, each of the end upright members 30' is configured to receive a specific one of the latch pins 43' at one end of the upper clamp beam 12' and not the other latch pin 43' at the other end of the beam 12'. For this purpose, in FIG. 26 it can be seen that the latch pin 43' has projecting portion 43*a*' that extends beyond the link member 32' for a greater distance than projecting portion 43*b*' of the pin 43' extends beyond the link member 34'. The side wall portion 50' includes an upwardly opening, inner pocket 186' recessed into the inner surface 188' thereof into which the shorter latch pin portion 43*b*' fits for being received therein. On the other hand, the side wall portion 48' has an upwardly opening slot 190' that extends therethrough from the inner surface 192' to the outer surface 194' thereof into which the longer pin portion 43*a*' fits for being received therein. As shown, the slot opening 190' is formed between the inclined surface 174' and the lowered surface 178' and extends downward therefrom. In this manner, if an operator attempts to latch the upper clamp beam 12' in an improper reverse orientation, attempting to orient the link members 32' and 34' to fit in the space in the end upright member 30' between the inner surfaces 188' and 192' for engaging the latch pin 43' with the latch member cam surface 54' will cause interference between the long pin portion 43*a*' and the upright side wall portion 50' before the pin 43' can be latched by the latch member 44'. Thus, the apparatus 10' has only a single orientation in which the upper clamp beam 12' can be latched to the lower base member 14'.

Once the upper clamping beam 12 is latched to the belt cutting apparatus 10 as described above, the clamping mechanisms 24 and 26, in particularly the screw drive mechanisms 40 thereof are operable to effect a quick clamping of the belt. In this regard, since the nut 42 is secured intermediate the length of the inclined link members 32 and 34 but free to travel in the clamp beam box shaped portion 36 up along screw shaft 56 of screw drive mechanism 40, the amount of downward travel by the clamping beam 12 generated by operation of the screw drive mechanism 40 is amplified over that which would occur without the end linkage assembly 28 herein. This is due to the pivoting action of link members 32 and 34 to which the screw nut 42 is rotatably secured with the link members 32 and 34 being pivotally fixed further inboard from the nut 42 in the upper clamp beam 12 at the pivot shaft 38 and also pivotally fixed at their lower, outboard ends at the latched pin 43. In this manner, the downward travel of the clamp beam 12 is amplified over the travel of the nut 42 if it were fixed to the clamp beam 12 without the pivotally secured inboard ends of the link members 32 and 34, thus allowing for a rapid clamping operation to be effected by turning of the screw knob 62.

Figure 5A:
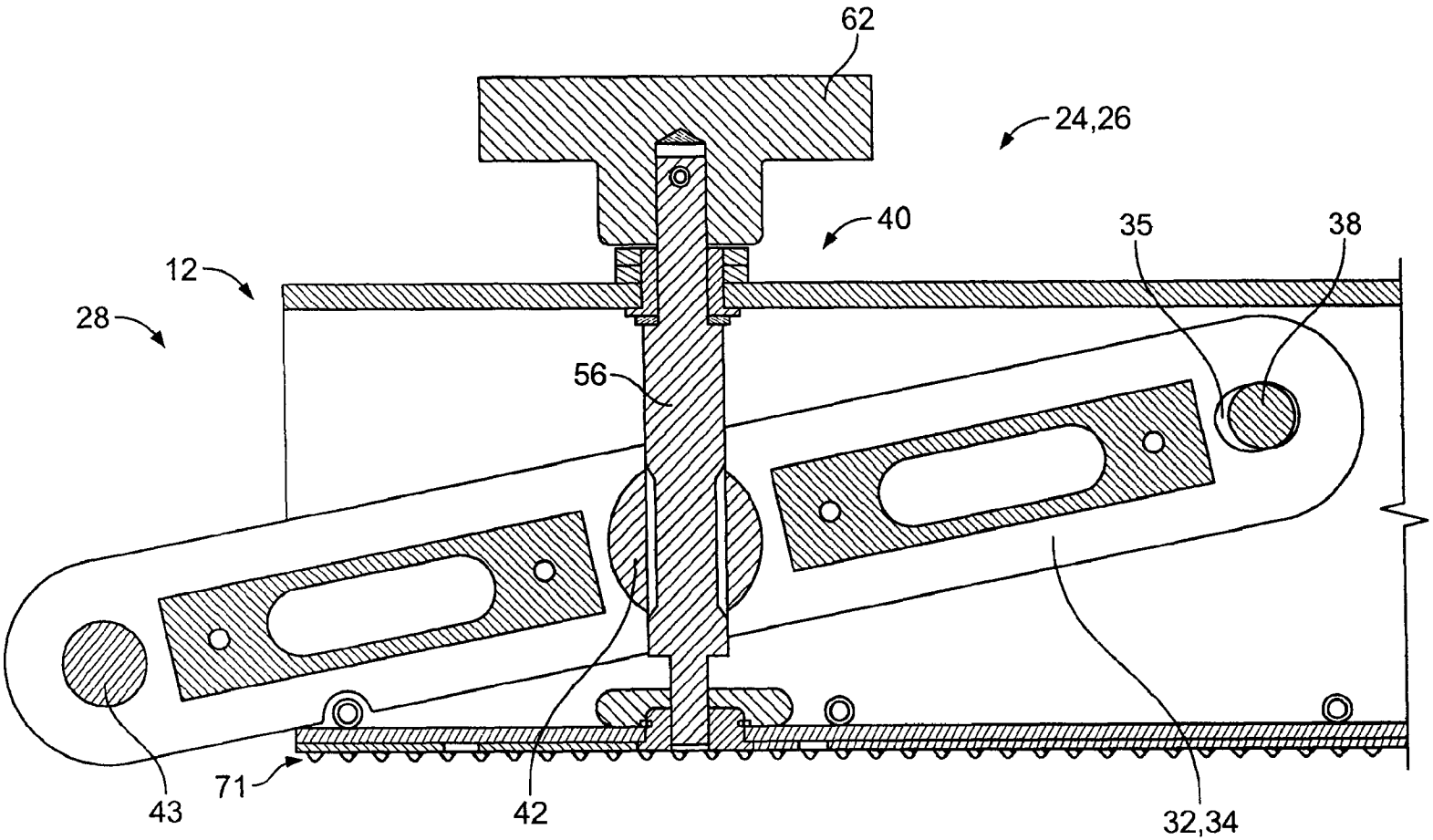

Since the link members 32 and 34 travel up and down in an arc about the anchored latch pin 43 and the pivot shaft 38 is fixed to the clamp beam 12, the link members 32 and 34 each have an elongated opening 35 through which the pivot shaft 38 extends as shown in FIG. 5*a*. The elongated opening 35 allows the pivot shaft 38 to shift from an inboard position in the opening 35 with the clamp beam 12 raised from the lower base member 14 and the link members 32 and 34 extending upwardly at an incline as illustrated in FIG. 5A. As the knob 62 is turned to rotate the screw drive shaft 56 for driving the clamp beam 12 down to clamp on the belt, the nut 42 travels upward on the shaft 56 and the pivot link members 32 and 34 rotate about the nut bosses 42*a* and 42*b* with the pivot shaft 38 shifting to a more outboard position in the opening 35 as the link members 32 and 34 shift to a more horizontal orientation.

In addition, the screw drive mechanism 40 includes a screw shaft 56 including a plurality of threads 58 therealong. Preferably, the threads 58 have a coarse, Acme-type configuration so as to have a relatively low pitch and which cooperate with mating, internal Acme-type internal threads 60 of the disc-shaped nut 42. The Acme threads 58 and 60 of the screw drive mechanism 40 also provide for increased travel speed of the upper clamp beam 12 when the screw knob 62 is turned. In the illustrated and preferred form as described above, the screw shaft 56 has eight threads per inch with four turns of the screw shaft 56 generating approximately one inch of downward travel of the clamp beam 12, versus the thirteen turns required for an inch of travel for a prior belt cutter using screw drive clamp mechanisms that have finer threads. In other words, with the end linkage assembly 28 of each of the clamping mechanisms 24 and 26 having an intermediate pivot connection at the screw drive shaft 56 approximately at the midpoint between the outboard anchored pivot connection at the latch pin 43 and the inboard fixed pivot connection at the pivot shaft 38 at either end of the link members 32 and 34, a lesser number of full turns of the screw shaft 56 is needed to achieve a given distance of clamp beam travel than the number of threads for that distance. In this instance, since the drive shaft 56 is approximately midway between the inboard and outboard pivot connections, a doubling of the rate of travel is achieved with only four turns of the screw shaft 56 required to achieve an inch of downward travel of the clamp beam 12 with these four turns only generating a half inch of upward travel of the nut 42 along the shaft 56 since there are eight threads per inch.

To even further increase the travel amplification provided by the end linkage assembly 28 herein, the shaft 56 could be moved further inboard toward the inboard pivot shaft 38 and away from the outboard latch pin 43. However, this would also reduce the clamping forces applied by the clamp beam 12 via operation of the screw drive mechanism 40 of the clamping mechanisms 24 and 26. It has been determined that having the shaft 56 at approximately the midpoint between the inboard and outboard pivot connections along the link members 32 and 34 provides both a desirable level of increased speed of clamping as well as a sufficient amount of clamping force on the belt, albeit reduced from the force level that would be applied from a direct drive screw type clamping mechanism. By way of example and not limitation, with the latch pin 43 approximately 4.5 inches from the nut 42 and shaft 56 extending therethrough, the pivot shaft is between 8.875 inches from the latch pin 43 at its minimum distance therefrom and 9.00 inches from the latch pin 43 at its maximum distance therefrom.

An additional characteristic of the end linkage assembly 28 is that the clamping mechanism 24 herein provides for reduction of clamp force applied to the conveyor belt for a given amount of torque applied by the operator at the screw knob 62. With prior direct drive-type screw clamp mechanisms, the high clamping forces generated thereby can be a problem. With prior screw drive mechanisms that directly apply high forces to the clamp beam 12, the clamp beam 12 needs to be designed to accommodate these concentrated high clamping forces.

With the end linkage assembly 28, in addition to a more rapid clamping operation as described above, the clamping forces applied by the clamping beam 12 are lower than if the screw drive mechanism 40 applied the clamping forces directly to the belt as discussed above. This is because the force applied with the clamping mechanisms 24 and 26 herein will only be a fraction of the force that would be applied if a direct drive screw drive mechanism 40 was employed. In this regard, when the knob 62 is turned in the closing or clamping direction, the link members 32 and 34 will swivel about the nut 42 as it travels up along the screw shaft 56 with the inboard end of the link members 32 and 34 pivoting about the pivot shaft 38 and the clamp beam 12 will travel downwardly. Thus, even though the clamping operation is faster with the clamping mechanism 24 due to the end linkage assembly 28 as well as the coarser Acme threads 58 and 60, the clamp forces applied by the upper clamping beam 12 on the belt can be more carefully controlled. In other words, the end linkage assembly 28 also beneficially provides for a clamping force reduction which aids in optimizing the design of the clamp beam 12 in terms of its size and weight while providing sufficient stiffness during a clamping operation to avoid excessive localized deflection of the clamp beam 12. In prior direct drive-type screw clamp mechanisms for belt cutters, the corresponding clamping beam would need to be a relatively large and heavy elongate member to handle the large clamping forces generated by the screw clamping mechanism without excessive deflection. By contrast, with the force reduction provided by end linkage assembly 28 herein, the clamp beam 12 can be more compact and of a lighter aluminum material while still being of sufficient stiffness to handle the clamping forces generated by operation of the screw drive mechanisms 40. For example, the weight of the clamp beam 12 can be approximately 7.6 pounds for a 36 inch length clamp beam 12; 10.1 pounds for a 48 inch length clamp beam 12; 12.6 pounds for a 60 inch length clamp beam 12; 15.1 pounds for a 72 inch length clamp beam 12; and 17.6 pounds for an 84 inch length clamp beam 12.

To increase the clamping forces with the clamping mechanisms 24 and 26 herein, the shaft 56 would need to be shifted closer to the outboard pivotal anchored end of the link members 32 and 34 at the latch pin 43. However, this would reduce the travel amplification and clamping speed to a level closer to that of a direct screw drive mechanism. Also, it has been found that a sufficiently high level of clamping force can still be generated by the clamping mechanisms 24 and 26 with the shaft 56 and nut 42 thereon located approximately midway between the inboard and outboard pivot connections thereby doubling the clamping speed with the present belt clamping apparatus 10 as discussed earlier.

In addition, the screw drive mechanism 40 allows an operator to apply a generally consistent clamping force to conveyor belts substantially irrespective of variations in thicknesses thereof since no compression springs or the like are relied upon to generate the clamping force. The present screw drive mechanism 40 does not have any lower limit in terms of minimum belt thicknesses that can be consistently clamped thereby. For instance, belts ranging in thicknesses from thin belts of three-eighths inch in thickness to thick belts up to one and one-half inches in thickness can be clamped with a consistent, high and even clamp force, e.g., between approximately 500 to 600 pounds, across their width with the belt cutter apparatus 10 herein.

Figure 2:
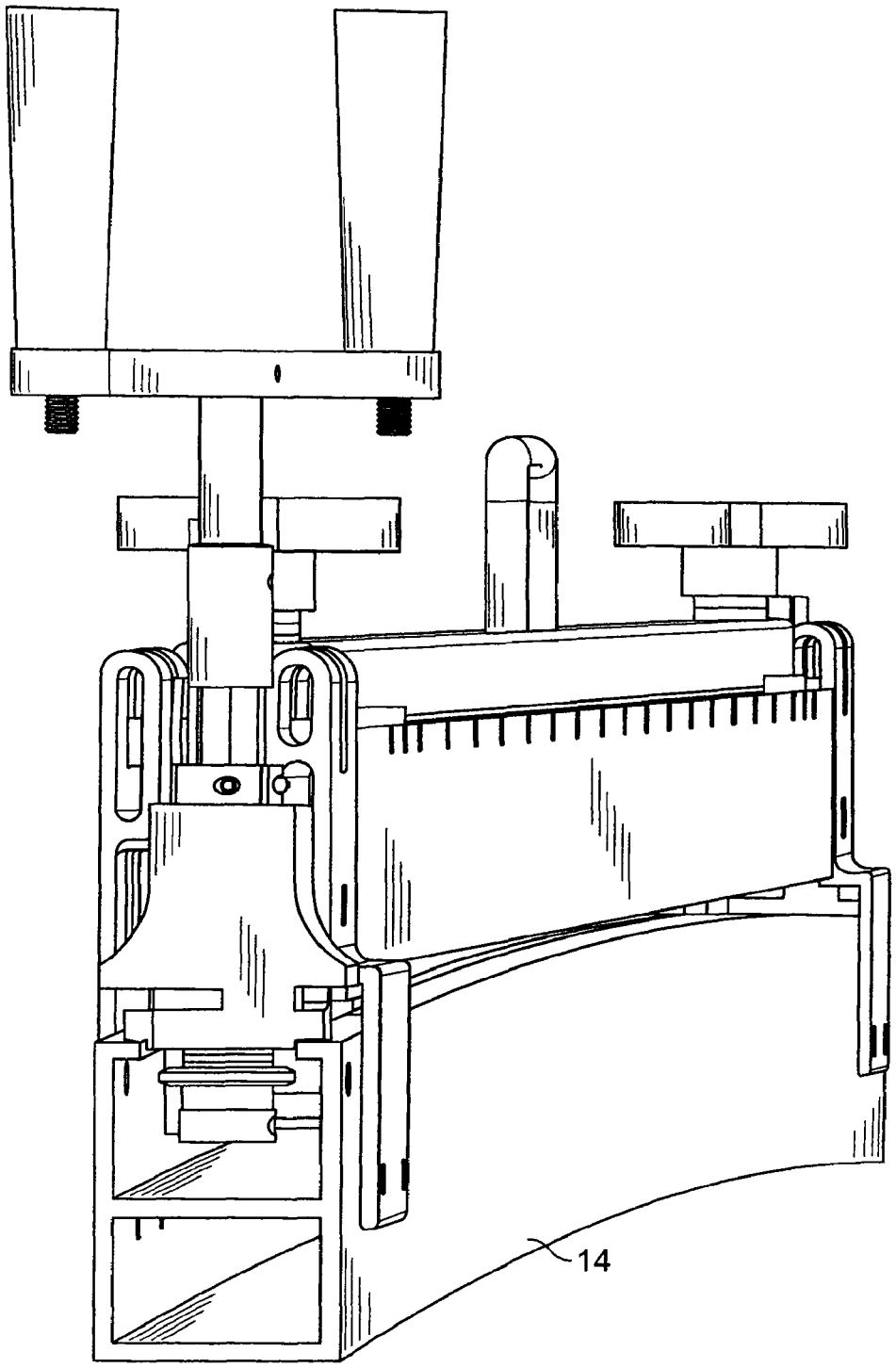
FIG. 2 is a perspective view of the belt cutting apparatus of FIG. 1 showing the curved configuration of the lower base member, and a drive assembly for driving a cutting blade through the clamped conveyor belt with a drive block thereof slightly displaced for generating an image of the curvature of the lower base member.

Referring again to FIG. 1, it can be seen that the screw drive mechanisms 40 are fairly close to the ends of the upper clamp beam 12. This keeps to a minimum the length of the outer portions of the long, upper clamp member 12 extending beyond the screw drive mechanisms 40 and thus assists in avoiding upward bending or deflection of these outer portions when the clamping beam 12 is clamped on a conveyor belt. In this regard, the longer, lower base member 14 is also provided with a camber or upward bow so that the center portion thereof is higher than the outer end portions, as shown in FIG. 2. This upward curvature of the lower base member 14 allows operation of the outwardly positioned clamping mechanisms 24 and 26 to cause the clamping beam 12 to deflect downwardly at its outer portions to tend to conform to the camber of the lower base member 14 while also tending to straighten the base member 14 during the belt clamping operation. In this manner, the clamping forces are more evenly distributed along the length of the elongate clamp members 12 and 14 and concentration of clamping forces at the clamping mechanisms 24 and 26 is substantially avoided.

Figure 12:
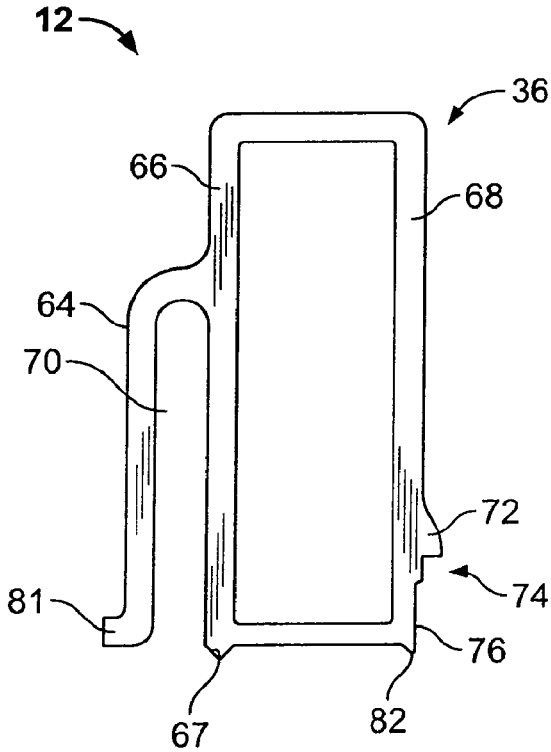
FIGS. 10-12 are views of the clamp beam.
Figure 10:
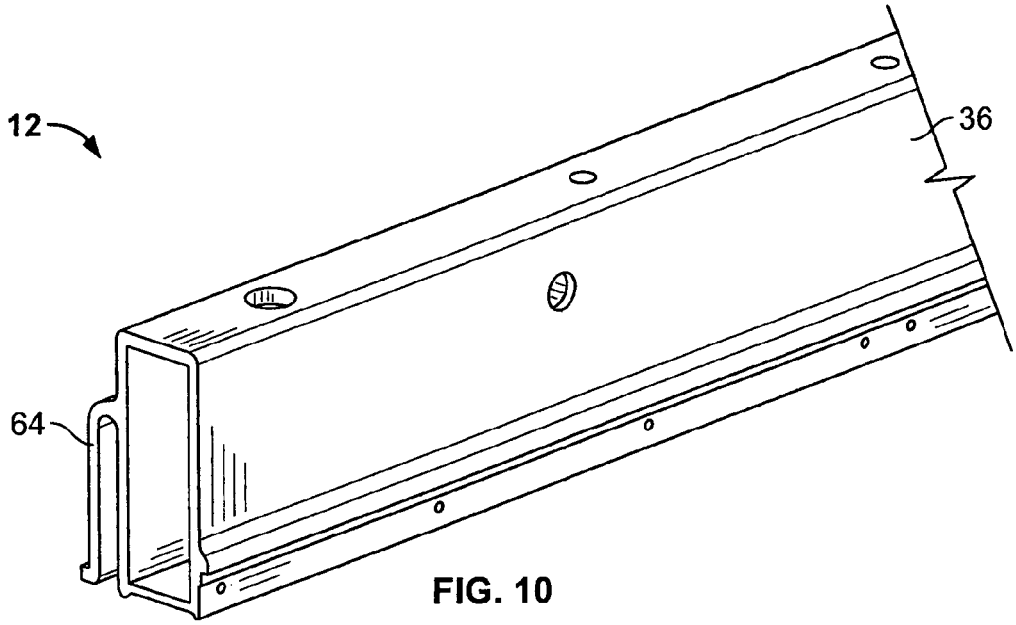
Figure 11:
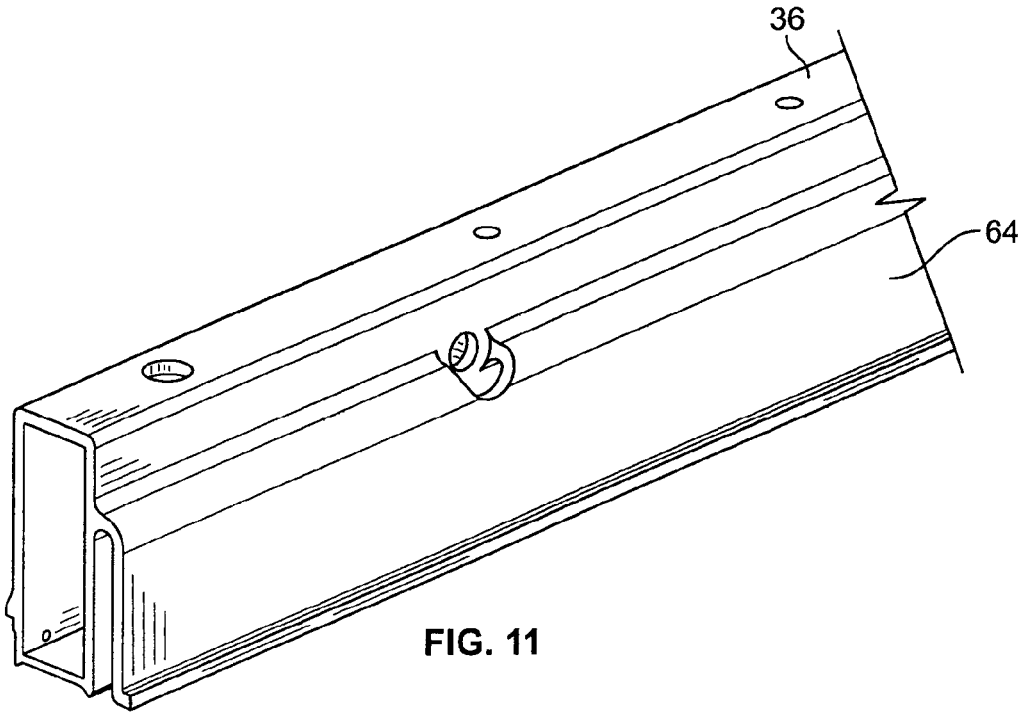

The upper clamp beam 12 has the elongate box-shaped portion or main clamping body 36 in which the link members 32 and 34 are pivotally fastened and to which the screw drive mechanism 40 is mounted, as has previously been discussed. In addition, the upper clamp beam 12 has a depending side leg 64 that extends downwardly from one side of the box-shaped portion 36, as best seen in FIGS. 10-12. The space 70 between the leg 64 and the portion 36 is configured to fit the upper portion of the cutting blade 18 therein, as will be discussed in more detail hereinafter. Clamping of the conveyor belt occurs at the box-shaped portion 36 along one side of the side leg 64. In this manner, the upper clamp beam 12 only clamps on the conveyor belt on one side of the cutting blade 18 so that as the cutting blade 18 cuts through the conveyor belt, the cut belt will peel away from the blade 18 out from under the bottom of the leg 64.

More specifically and referring to FIG. 12, the box-shaped portion 36 of the clamp beam 12 has opposite vertically extending side walls 66 and 68. The upper portion of the cutting blade 18 fits into the space 70 between the side leg 64 and the side wall 66, as previously discussed. In the belt clamping and cutting apparatus 10', gussets 196' are provided at either end of the clamp beam 12' to reinforce the beam 12', and specifically the side leg 64' at the ends thereof, as can be seen best in FIGS. 27 and 28. The gussets 196' are in the form of generally narrow plates 198' secured at their inner edge to the outer surface 202' of the clamp beam 12' along the top of the box-shaped main body portion 36', and down along the upper portion of the side wall 66' and the side leg 64'. Clamping of the conveyor belt occurs at the bottom of the side wall 66 and at the bottom of the side wall 68 via a clamping member mounted thereto. More particularly, a plurality of thin, toothed, strip clamping members 71 (FIG. 6) are secured to the bottom of the side wall 68 so that the teeth project beyond the bottom thereof for clamping into the belt as the upper clamping beam 12 is driven downwardly by operation of the clamping mechanisms 24 and 26. For this purpose, the side wall 68 has an enlarged abutment 72 spaced upwardly from the bottom of the wall 68. A stepped recess 74 is formed below the abutment 72 with a lower narrow portion 76 of the recess adapted to receive the thin toothed strip members 71. To secure the toothed strip clamping members 71 in the recess portion 76, a plurality of long fastening bars 78 are fastened in the recess 74 engaged under the abutment 72, as best seen in FIG. 6. Rivets 80 secure the bars 78 in the recess 74 and the toothed strip members 71 in the narrow recess portion 76.

As previously described, since the toothed strip members 71 and the bottom tip 67 of the wall 66 clamp the conveyor belt on one side of the cutting blade 18, the torque required to be applied to the drive handle 16 for the cutting blade assembly 20 is significantly lower for generating a given amount of drive force at the cutting blade 18 than in prior belt cutting devices. In addition, the bottom foot 81 of the side leg 64 is higher than the bottom 67 of the side wall 66 and the bottom tip 82 of the side wall 68 and thus also higher than the teeth of the toothed strip member 71 projecting below the tip 82 so that the belt is clamped at a position lower than the bottom foot 81 to allow the cut belt to freely peel away from the cutting blade 18 as it is driven through the belt.

By sectioning the strip members 71 into several reduced length strip members 71, their removal and replacement is made simpler and less costly. Instead of having to remove and replace a single long clamp strip member when it is damaged at only one or two locations, for example, only the specific smaller strip member 71 or members 71 where the damage is located need to be removed and replaced. Further, the smaller strip members 71 eliminate the need to stock different sizes of strip clamp members for different sizes of the belt cutter apparatus 10. Instead, only one size of the smaller strip toothed member 71 need be provided for use on all of the different sizes of belt cutters 10 with only the number of such strip toothed members 71 varying depending on the belt cutter size.

Figure 18A:
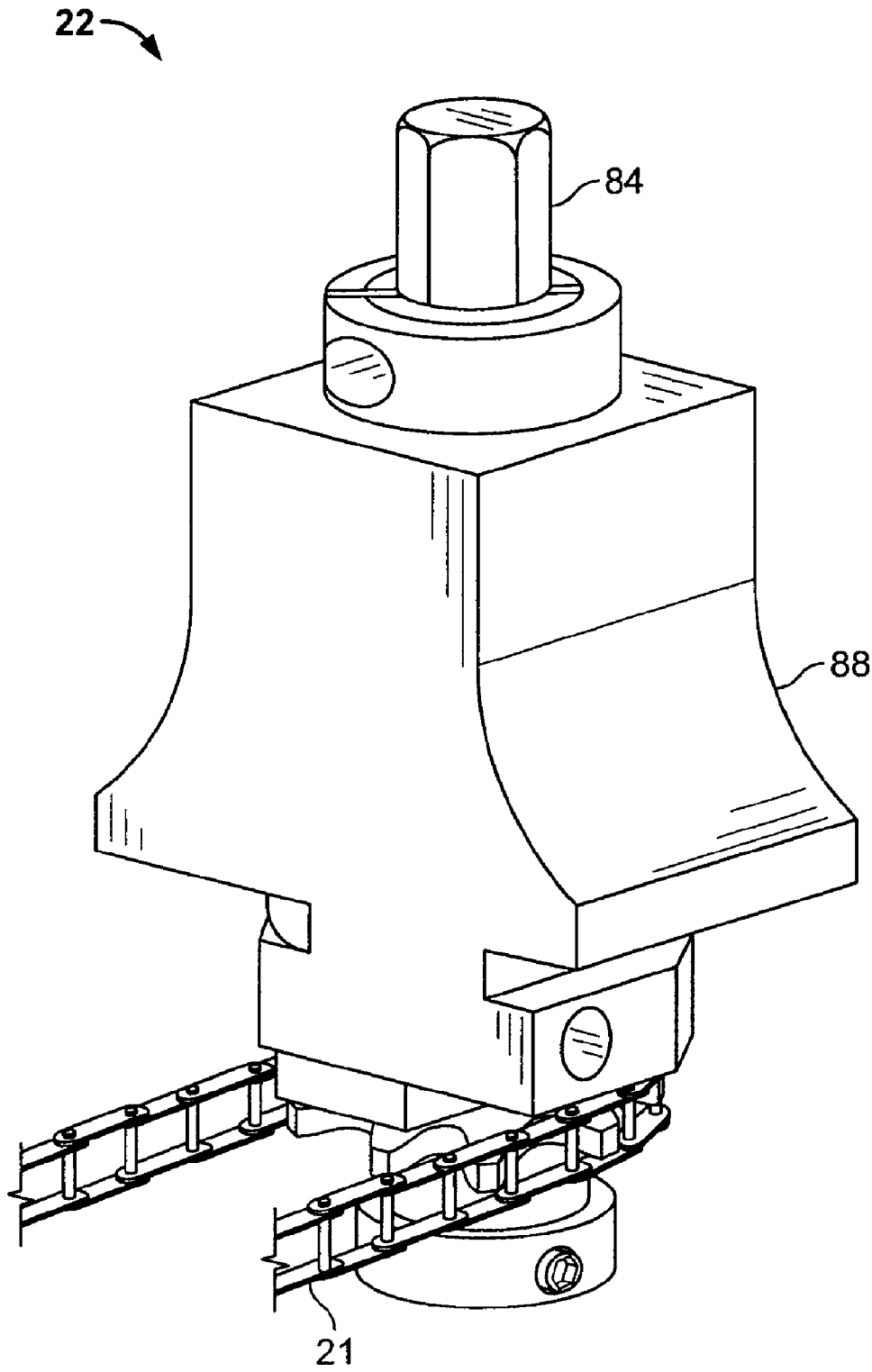
FIGS. 18A-18C are perspective views of the blade drive assembly with the drive handle removed showing a drive block and a driveshaft extending therethrough to a chain sprocket at the lower end of the drive block.
Figure 18B:
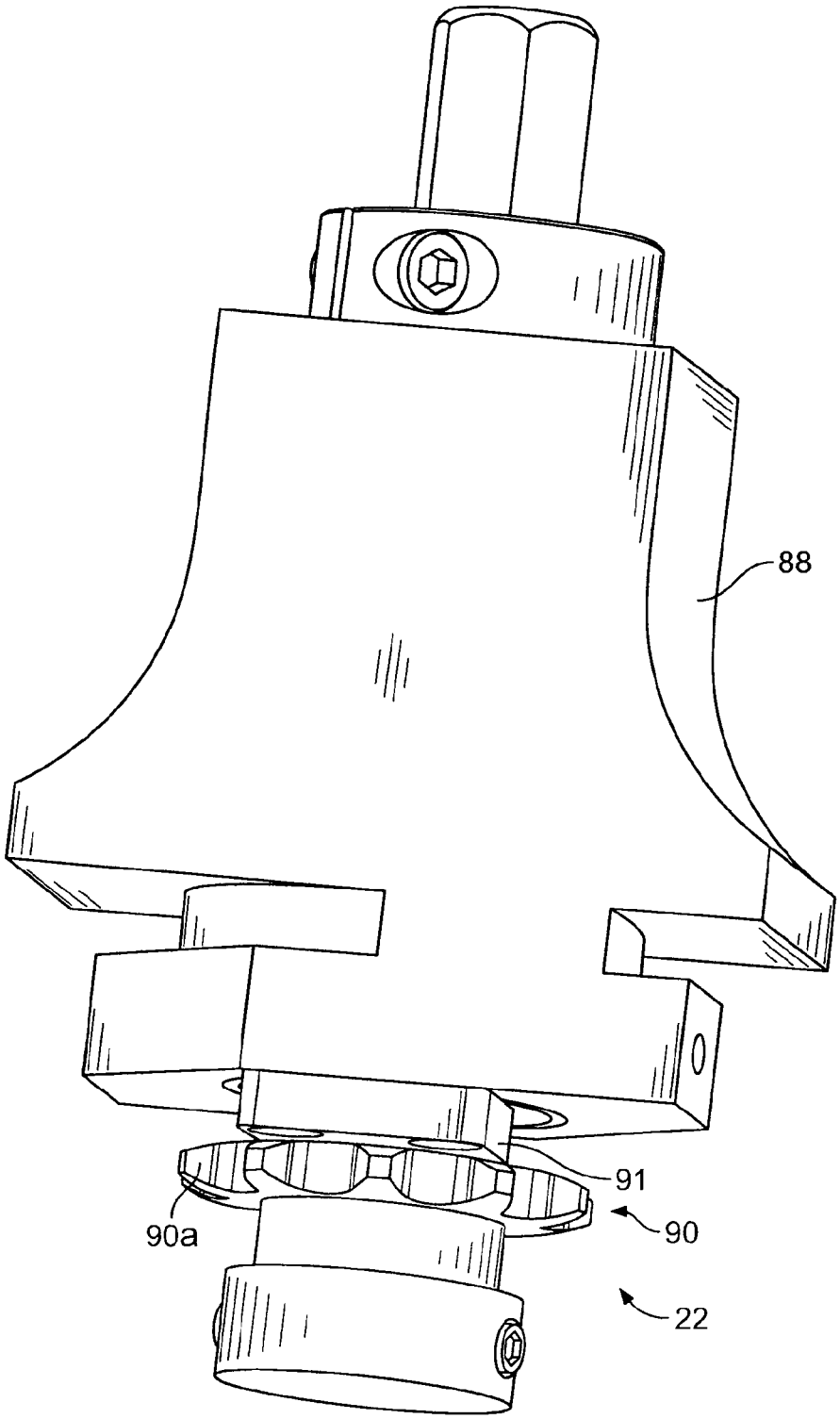
Figure 18C:
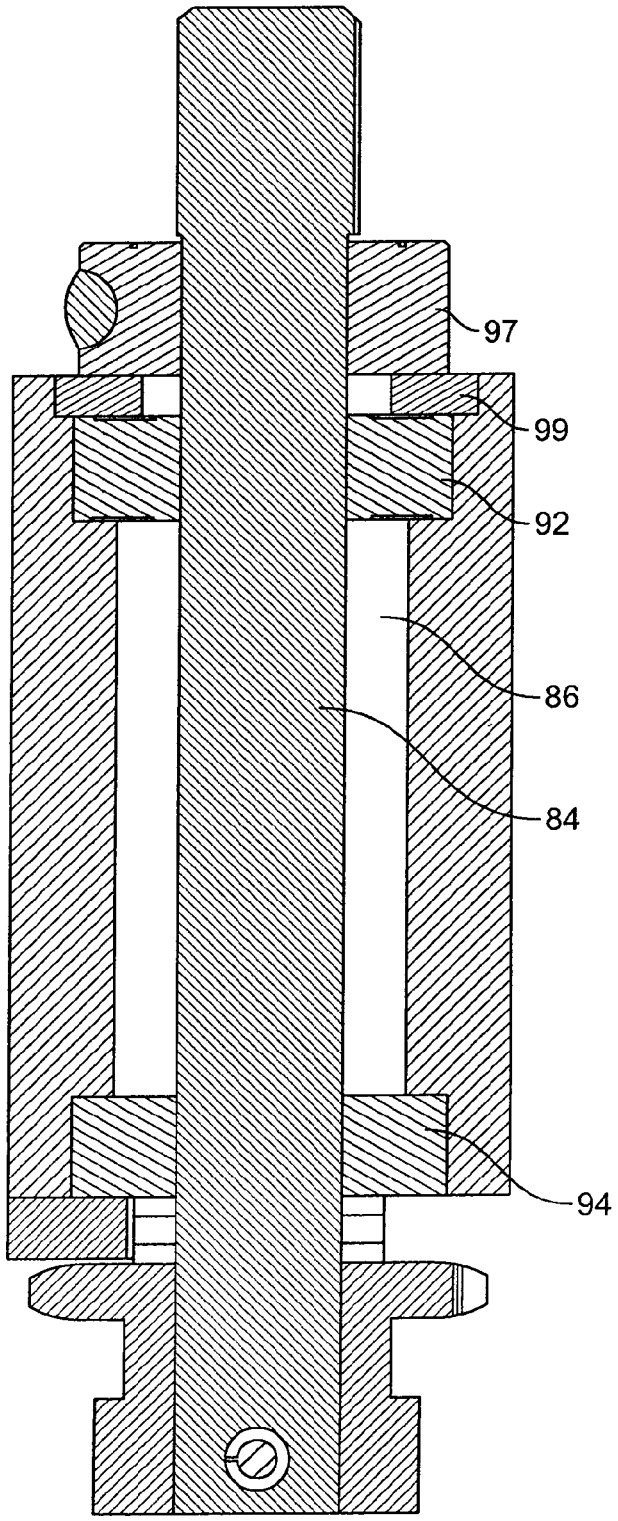

To drive the cutting blade assembly 20, a drive shaft 84 extends through a throughbore 86 formed in drive block 88. The drive shaft 84 is coupled to the drive handle 16 at its upper hex end projecting out from the top of the drive block 88 and has a sprocket 90 secured at its lower end projecting out from the bottom of the drive block 88, as can be seen in FIGS. 18A-18C. Accordingly, when an operator applies torque and turns the drive handle 16, the drive shaft 84 turns the sprocket 90 which is part of the chain drive mechanism 22 for the cutting blade assembly 20.

As shown in FIG. 18B, a chain stripper 91 is secured at the bottom of the drive block 88 between the drive block 88 and the sprocket 90. The chain stripper 91 has a body 91*a* with a plate-like configuration that projects beyond the periphery of the sprocket teeth 90*a* in the direction of the drive chain 21 between either side run 21*a* and 21*b* thereof as it feeds onto and leaves from the rotating sprocket 90 toward the sprocket 90 at the other end of the belt cutter apparatus 10. With the projecting plate-like chain stripper 91 secured immediately below the sprocket 90 and projecting therefrom as shown in FIG. 18B, the chain 21 will be forced to release properly from the sprocket teeth 91 in a generally tangential direction from the sprocket 90 rather than continuing to wrap around the sprocket such as if excessive slack develops in the chain 21.

Figure 30:
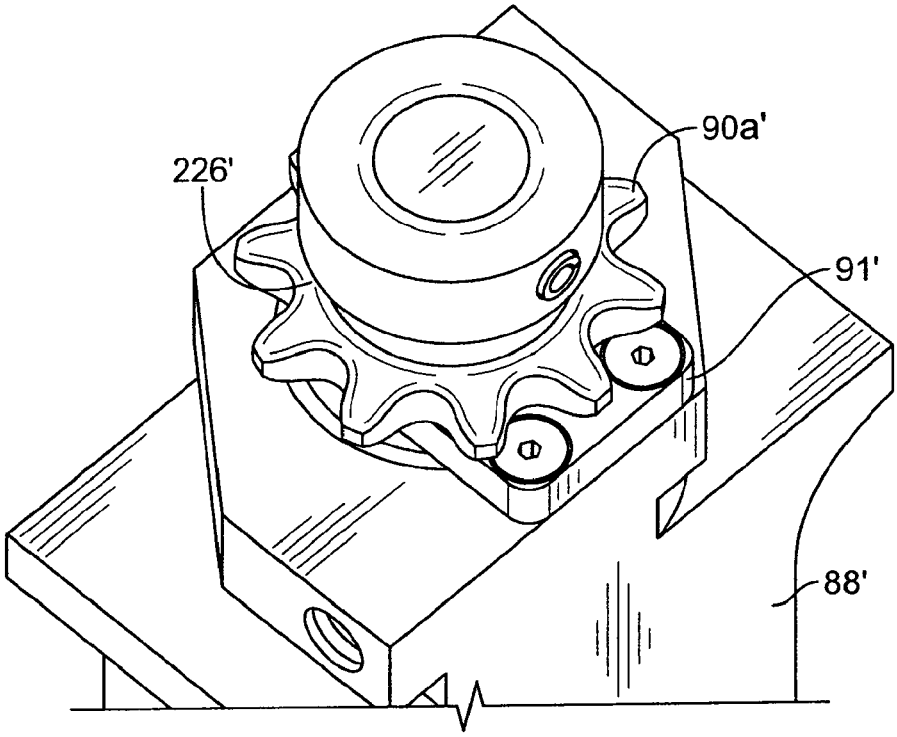
Figure 31:
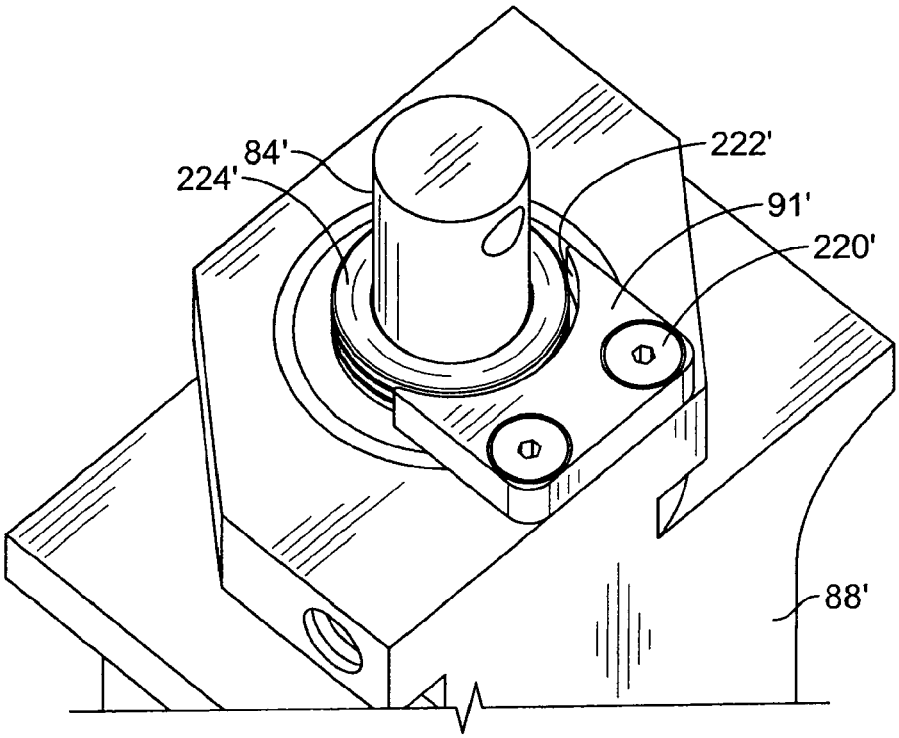
Figure 32:
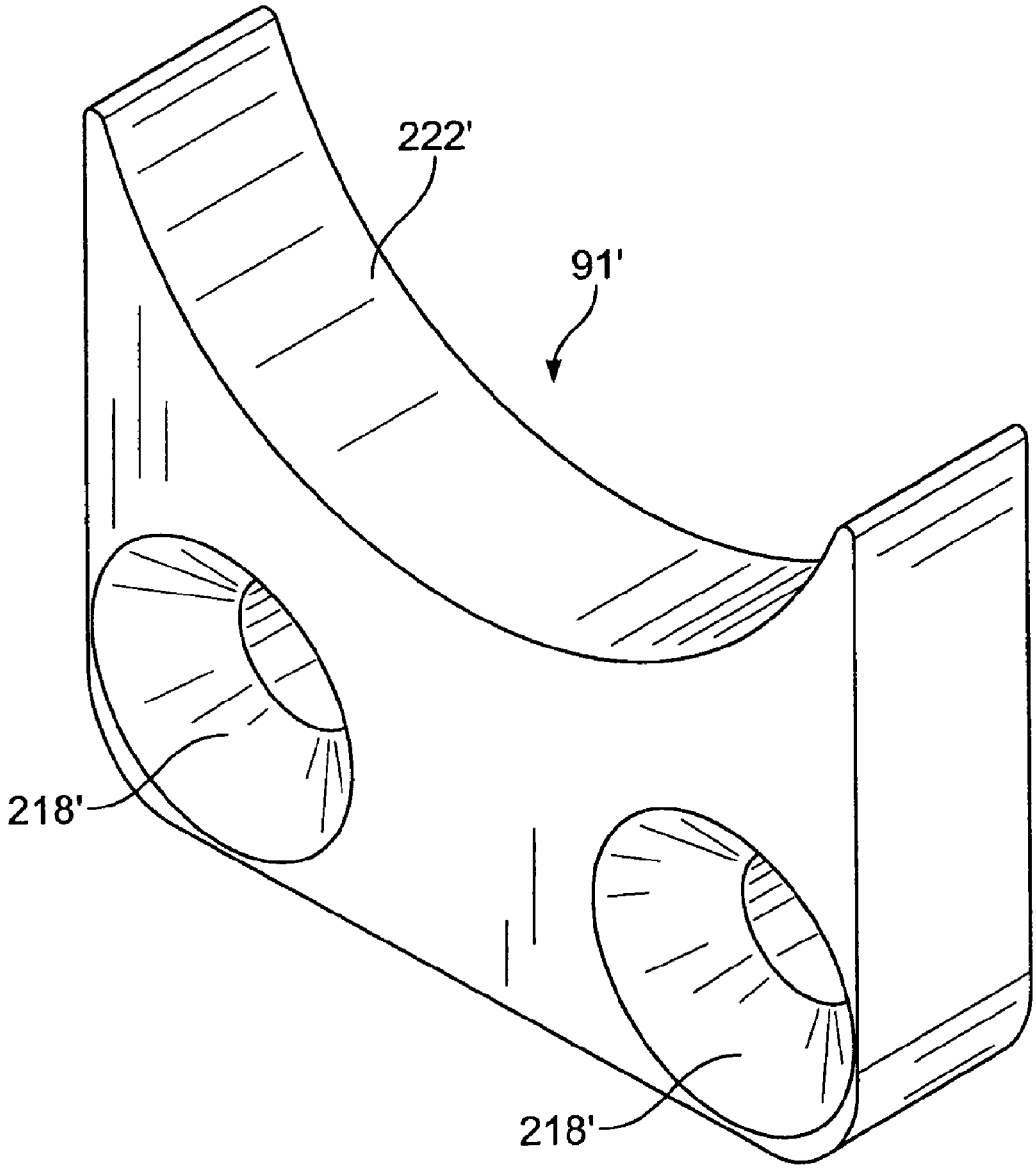
FIG. 32 is a perspective view of a chain stripper.

FIGS. 30-32 show the identical chain stripper 91' for the apparatus 10'. As can be seen, the chain stripper body 91*a'* has a pair of through openings 218' for receiving bolts 220' therethrough to fasten the chain stripper 91' to the bottom of the drive block 88'. With the chain stripper 91' secured to the drive block 88', an arcuate edge 222' of the plate body 91*a* extends about a stack of thrust washers 224' mounted on the lower end portion of the drive shaft 84' that projects out from the bottom of the drive block 88'. As shown, the plate body 91*a'* has a width that is approximately the same as the diameter of annular sprocket body 226' which is smaller than the effective diameter across the outer ends of the sprocket teeth 90*a'* but nevertheless sufficient in size to keep the chain separating from the sprocket teeth 90*a'* in a direction generally tangential to the sprocket body 226'.

Figure 19A:
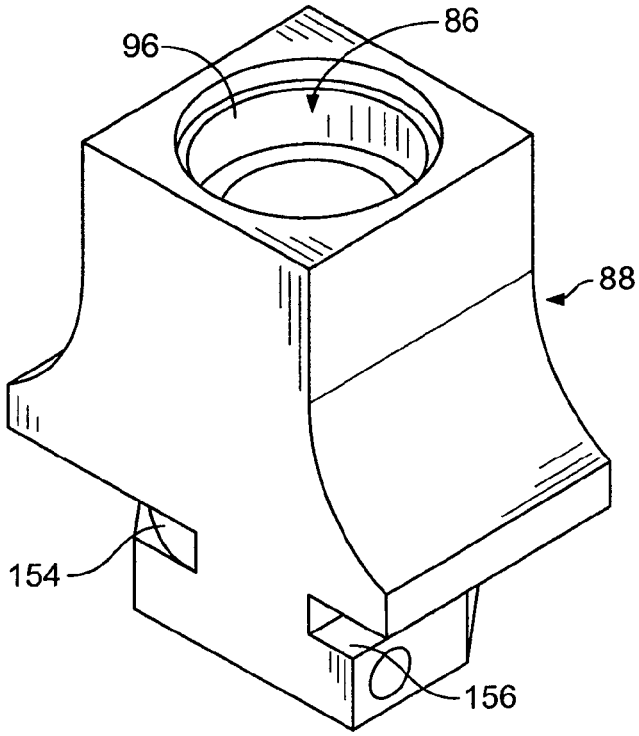
FIGS. 19A and 19B are perspective views of the drive block of FIGS. 18A-18C.
Figure 19B:
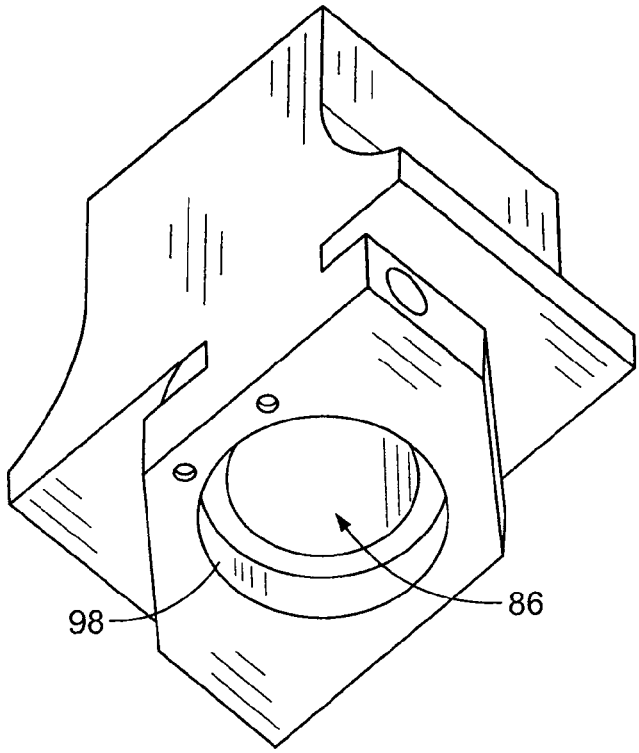

In Applicant's assignee's prior belt cutter, bushings were used for the corresponding drive shaft for the cutting blade. In the drive block 88, ball bearings 92 and 94 rotatably support the drive shaft 84 at upper and lower ends of the drive block 88, as can be seen in FIG. 18C. These ball bearings 92 and 94 also contribute to the greater efficiency in transmitting the torque applied to the drive handle 16 through the drive shaft 84 and the chain drive mechanism 22 to generate cutting forces at the cutting blade 18 of the cutting blade assembly 20. As shown in FIGS. 19A and 19B, counterbore recesses 96 and 98 are formed at the upper and lower ends of the throughbore 86 into which the respective upper and lower ball bearings 92 and 94 are press-fit. Since the ball bearings 92 and 94 do not handle axial thrust loads, an upper clamping collar 97 and an upper thrust washer 99 are provided at the top of the drive block 88 for this purpose. Since the sprocket 90 is cantilevered off the bottom of the drive block 88, most of the forces are taken by the lower ball bearing 94. In this regard, it is contemplated that a bushing could be employed for the upper bearing rather than ball bearing 92.

As previously mentioned, the chain 21 of the chain drive mechanism 22 is attached to the cutting blade assembly 20 so as to minimize moments generated during driving of the cutting blade 18 through the conveyor belt. More particularly, the chain 21 is connected to the cutting blade assembly 20, and specifically the blade holder member 100 (FIGS. 13 and 14) thereof, so as to be substantially in line with the cutting blade 18. For this purpose, the blade holder member 100 has end openings 102 and 104 in which links of the chain 21 are received and captured therein by chain pins 106 and 108, respectively. To keep the blade 18 substantially in line with the chain 21 as the chain travels about the sprocket 90, the tangent to the sprocket 90 is arranged to be more in line with the cutting blade 18 and the pins 106 and 108. Thus, while the cutting blade 18 is off-center with respect to the center of the sprocket 90, the chain 21 trained around the sprocket 90 is in substantial alignment with the blade 18 so that the drive forces from the chain 21 are in line with the blade 18 thus efficiently transferring forces from the chain 21 to the cutting blade assembly 20 and specifically the aligned cutting blade 18 thereof.

Figure 13:
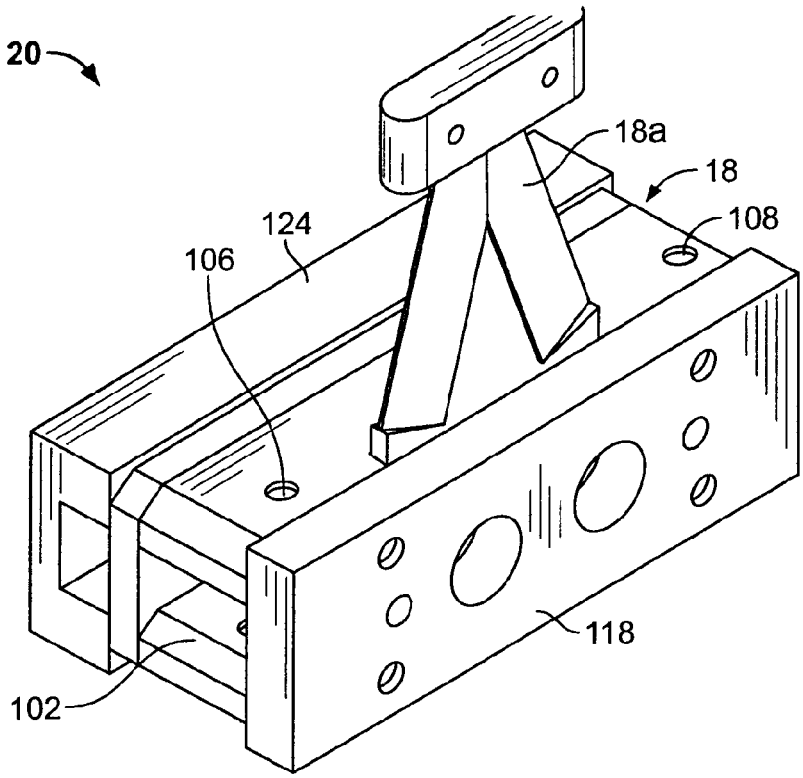
FIG. 13 is a perspective view of the cutting blade assembly showing a cutting blade projecting upwardly from a blade holder and having an upper blade guide member secured thereto.
Figure 14:
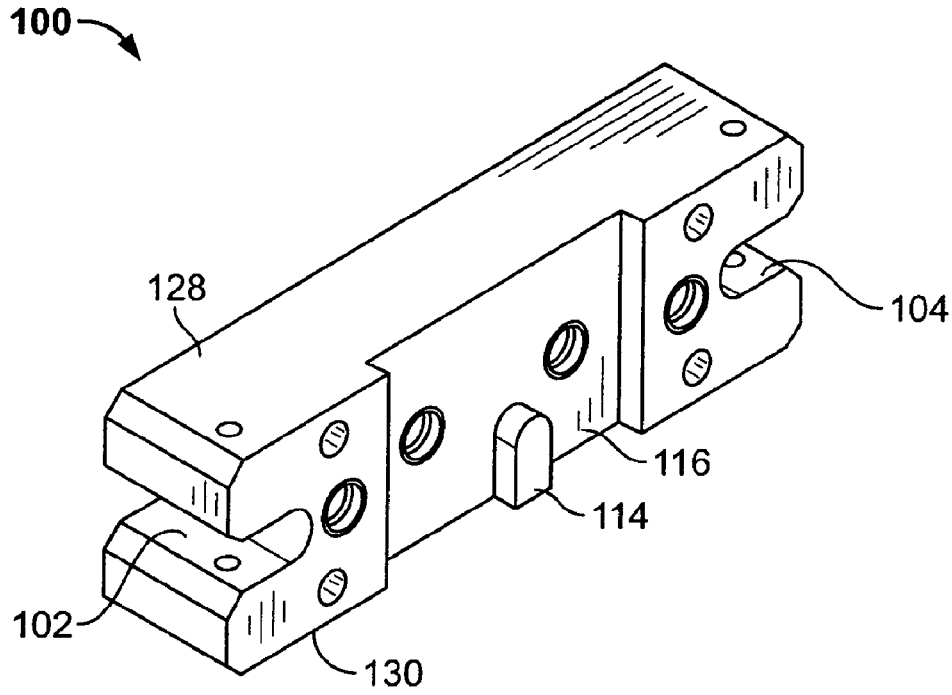
FIG. 14 is a perspective view of a blade holder member of the cutting blade assembly.
Figure 21:
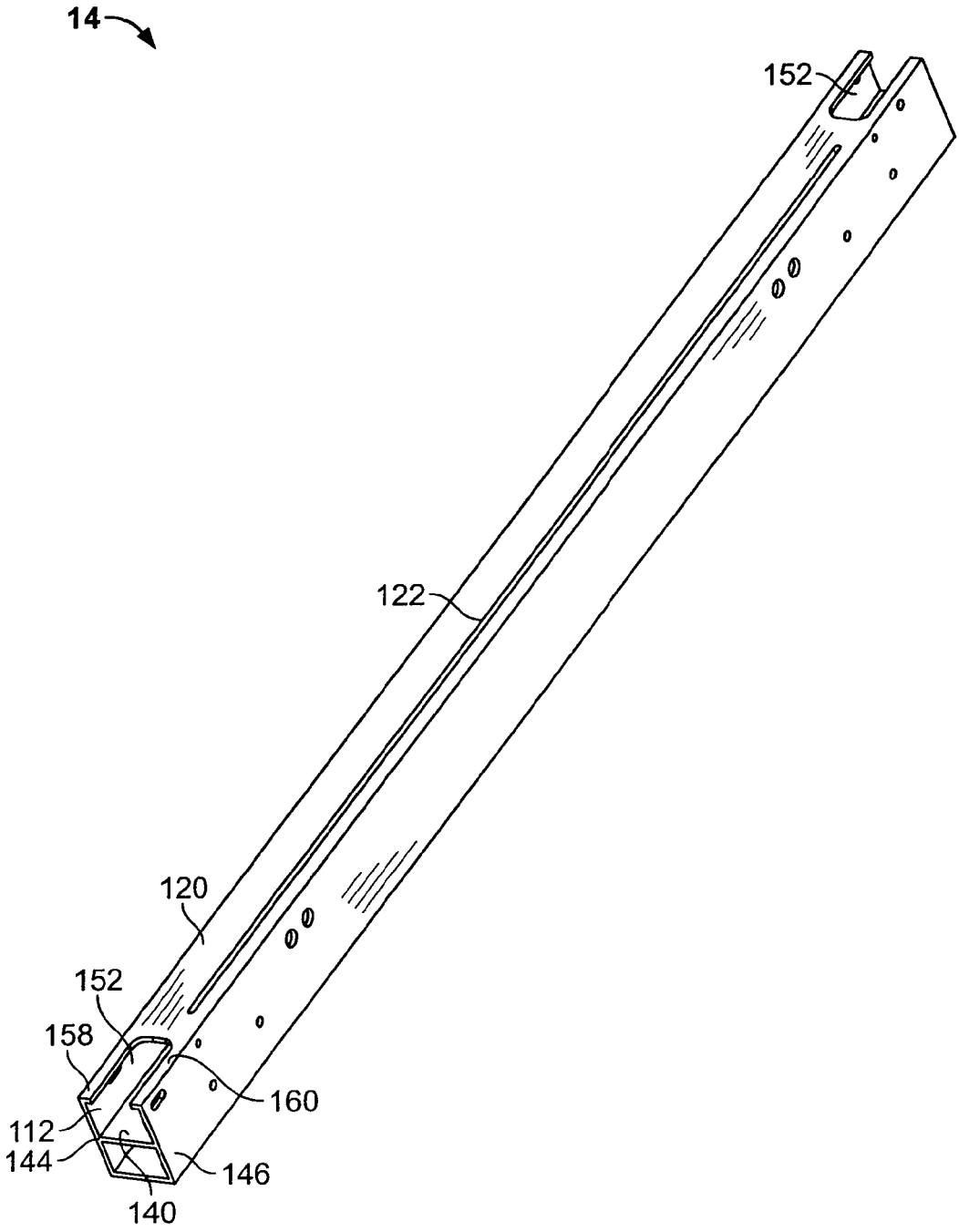
FIG. 21 is a perspective view of the long base member including an upper chamber for the cutting blade assembly and an upper slot through which the cutting blade extends.
Figure 22:
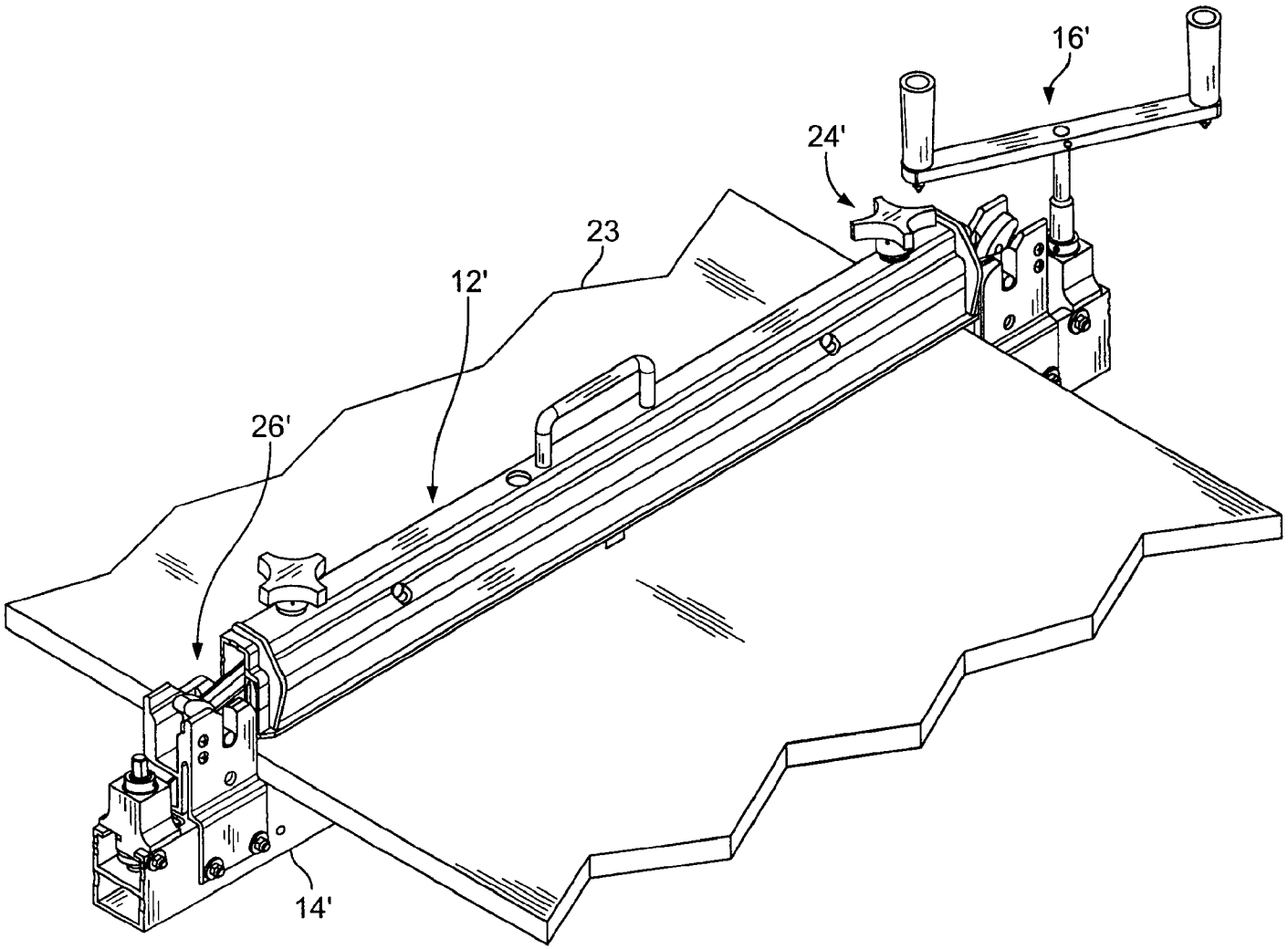
FIGS. 22-31 are views of an alternate embodiment of the belt clamping and cutting apparatus.

The blade guide assembly 20 is chain driven in the hollow base member 14, and specifically upper elongate compartment 112 thereof (FIG. 21). The blade holder 100 has a blade mounting projection 114 located at the bottom of a side recess 116 thereof, as shown in FIG. 14. The cutting blade 18 has a corresponding notch opening 200 at its lower end portion 18*c* offset from the vertical centerline of the blade 18 for receiving the projection 114 therein so that the blade 18 and blade cutting portion 18*a* thereof is in proper orientation for cutting to extend upwardly. A side guide plate 118 is loosely mounted to the side of the blade holder member 100 at which the recess 116 is formed, as shown in FIG. 13. A pair of fasteners extending through aligned openings of the guide member 118, the blade 18, and the holder member 100 in the recess 116 thereof to secure the blade to the blade holder member 100. In this manner, the cutting blade 18 is secured to the cutting blade assembly 20 and the blade holder member 100 thereof so that the upper cutting portion 18*a* of the blade 18 projects upwardly therefrom. The base member 14 has a top wall 120 provided with an elongated slot 122 along one side thereof, as can be seen in FIG. 21. The top wall 120 serves as a support surface for the conveyor belt for being clamped thereagainst by the upper clamping beam 12 with the upper portion 18*a* of the cutting blade 18 projecting through the slot 122 to be driven therealong by the chain drive mechanism 22 for cutting the belt across its width.

Figure 15:
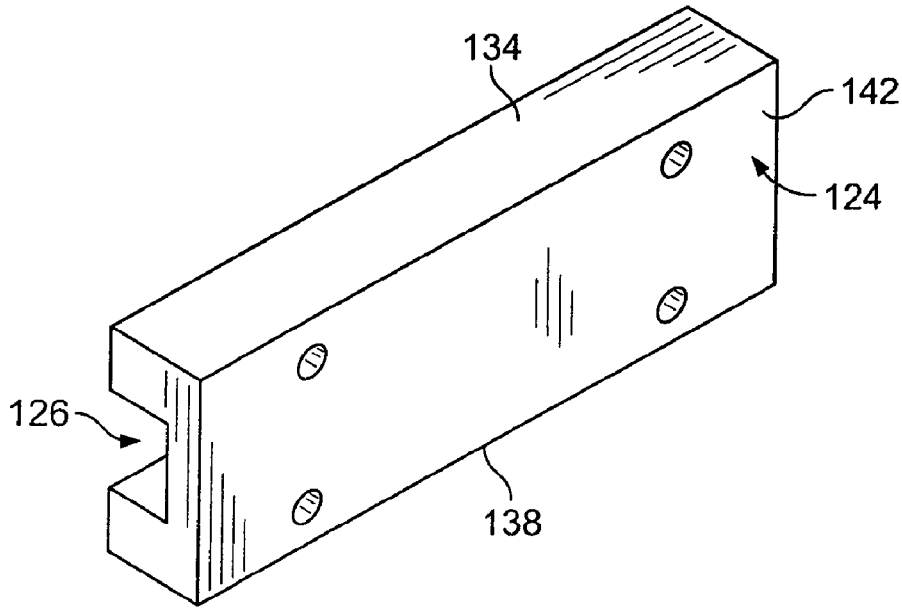
FIGS. 15 and 16 are perspective views of opposite side guide blocks of the cutting blade assembly.
Figure 16:
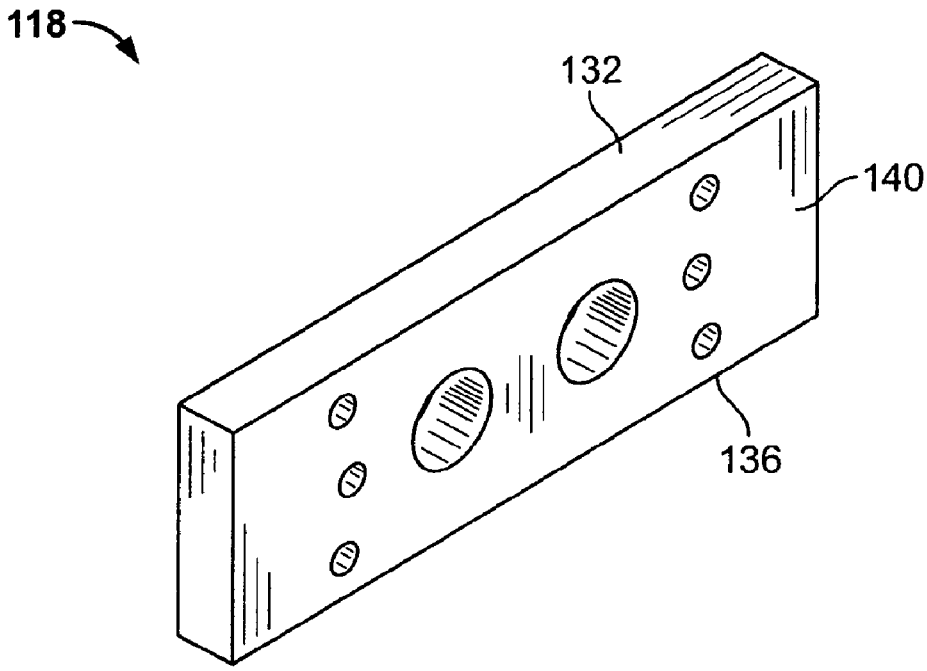

In addition to the side guide plate 118, the cutting blade assembly 20 includes a side guide block 124 (FIG. 15) loosely mounted to the other side of the blade holder member 100, as shown in FIG. 13. The side guide member 124 has a central, elongate open channel 126 formed therein to accommodate the return run of the chain 21 of the chain drive mechanism 22 extending therethrough. As shown, there are four aligned through apertures in each of the metal holder member 100 and the guide members 118 and 124 for receiving four mounting pins therethrough with the guide members 118 and 124 supported with a loose, running fit thereon.

Preferably, the side guide members 118 and 124 are of identical heights, e.g., 1.38 inches, while the blade holder member 100 which preferably is of a metal material such as aluminum, is of a smaller height than the guide members 118 and 124, e.g., 1.25 inches. In this manner, with the blade holder member 100 centered between the side guide members 118 and 124 as shown in FIG. 13, the top and bottom surfaces 128 and 130 of the metal blade holder member 100 will be recessed from the corresponding adjacent top surfaces 132 and 134 of the respective side guide members 118 and 124 and the adjacent bottom surfaces 136 and 138 thereof. The guide members 118 and 124 are preferably of a low friction plastic material such as ultra high molecular weight polyethylene, so that engagement of the surfaces 132-138 thereof with the metal material of the base member 14 will not generate high friction therebetween.

More specifically, the upper chamber 112 of the base member 14 includes an elongate, horizontal web wall 140 on which the guide members 118 and 124, and specifically their respective bottom surfaces 136 and 138, ride while their top surfaces 132 and 134 can engage the interior surface of the top wall 120 of the base member 14. Similarly, the guide members 118 and 124 have outer side surfaces 140 and 142, respectively, which can be in low friction engagement with the metal interior surfaces of corresponding side walls 144 and 146 of the base member 14.

Figure 13A:
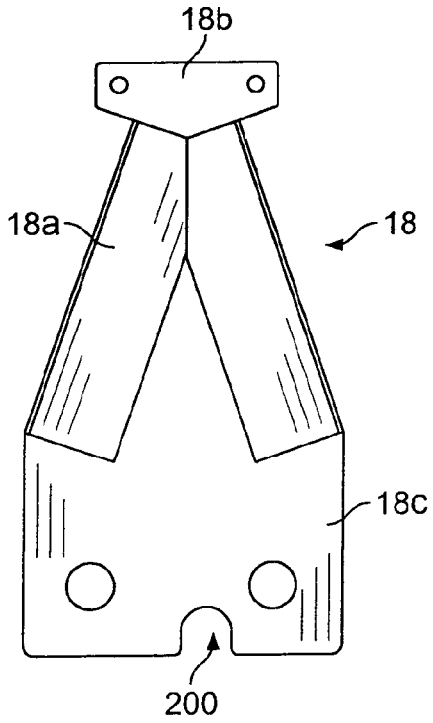
FIG. 13A is an elevational view of the cutting blade of the cutting blade assembly shown in FIG. 13.
Figure 17:
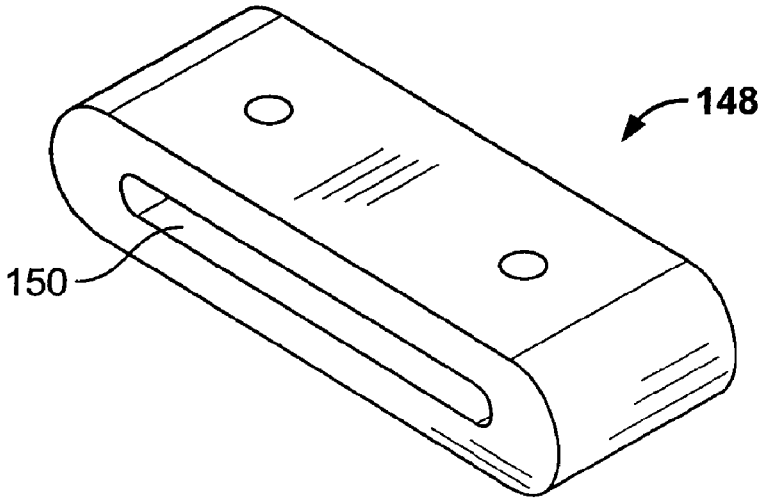
FIG. 17 is a perspective view of the upper blade guide member.

The cutting blade assembly 20 is also elongated in the blade travel direction so as to provide the blade 18 with improved stability as the upper cutting portion 18*a* thereof extending above the holder 100 experiences cutting loads as it cuts through the belts, particularly with conveyor belts of increased thicknesses. In this regard, it is preferred that the blade holder 100 and side guide members 118 and 124 have a length of approximately four inches which is twice that of the blade holder in the Applicant's assignee's prior belt cutter. An additional improvement is the use of an upper blade guide 148 (FIG. 17) preferably of a low friction material such as ultra high molecular weight polyethylene or a Delren® material, that is secured to the upper mounting end 18*b* of the cutting blade 18, as shown in FIGS. 13 and 13A. The upper blade guide 148 has a generally racetrack cross-sectional configuration so as to form a slot 150 into which the top end 18*b* of the blade 18 is received and secured. The blade guide 148 fits in the space 70 between the side leg 64 and side wall 66 of the metal clamp beam 12 for low friction engagement with the interior surfaces of the leg 64 and side wall 66. In this manner, the cutting blade 18 is supported and guided during its cutting action both at its lower portion 18*c* and at its uppermost portion 18*b* so that the cutting blade 18 can be rigidly driven through the clamped conveyor belt with the low friction plastic material of the side guide members 118 and 124 and upper guide member 148 providing for low friction engagement with the surfaces of the lower base member 14 and upper clamp beam 12 they engage. In this manner, the driven rigid blade 18 allows for a more accurate, square cut of the belt to be achieved therewith. By rigidly supporting the cutting blade 18 both at its lower end portion 18*c* and at its uppermost end portion 18*b* the blade 18 at cutting portion 18*a* thereof can be increased in height, e.g., 1.62 inches, to allow for thicker and/or tougher belts to be cut therewith. This increased height of the cutting portion 18*a* is in comparison with a shorter height of approximately 1.12 inches for the corresponding cutting portion of the cutting blade of Applicant's assignee's prior standard belt cutter that has been previously discussed. This increased blade height allows for the maximum thickness of belts to be cut with the belt cutting apparatus 10 herein to be approximately 50% thicker than the maximum belt thickness cut with applicant's assignee's prior belt cutter. For greater blade heights, modifications need to be made to the prior belt cutter such as by increasing the thickness of the blade which undesirably increase costs associated therewith. Also, since deflection varies by the length cubed, a blade that is approximately 50% taller such as blade 18 herein would be expected to undergo three times as much deflection as applicant's assignees prior blade. However, the rigid upper and lower support allows for the thickness of the cutting blade 18 to be maintained the same despite the significantly increased height thereof.

As can be seen in FIGS. 33-36, the test results for the present belt cutting apparatus 10 against Applicant's assignee's prior belt cutter show a much greater level of efficiency in transmitting the torque applied to the drive handle 16 to the load generated on the cutting blade 18. This results from the combination of the various features described herein, including the use of ball bearings to support the drive shaft 84 of the chain drive mechanism 22, the orientation of the chain 21 of the chain drive mechanism 22 in line with the cutting blade 18, and the construction and arrangement of the cutting blade assembly 20, described above. As can be seen in the graph of FIG. 36, the belt cutting apparatus 10 herein is much closer to one hundred percent efficient than the prior belt cutter in terms of force transmission from the drive handle 16 to the cutting blade 18.

Turning to more of the details, the top wall 120 of the elongate base member 14 has open ended slots 152 formed at either end thereof for mounting of the drive blocks 88 thereto.

In this regard, each of the drive blocks 88 include side grooves 154 and 156 into which opposing flange portions 158 and 160 on either side of the slots 152 of the top wall 120 fit to allow the drive block 88 to be slid into position in the slots 152 for being secured to the elongate base member 14, as shown in FIGS. 3 and 4.

Figure 20:
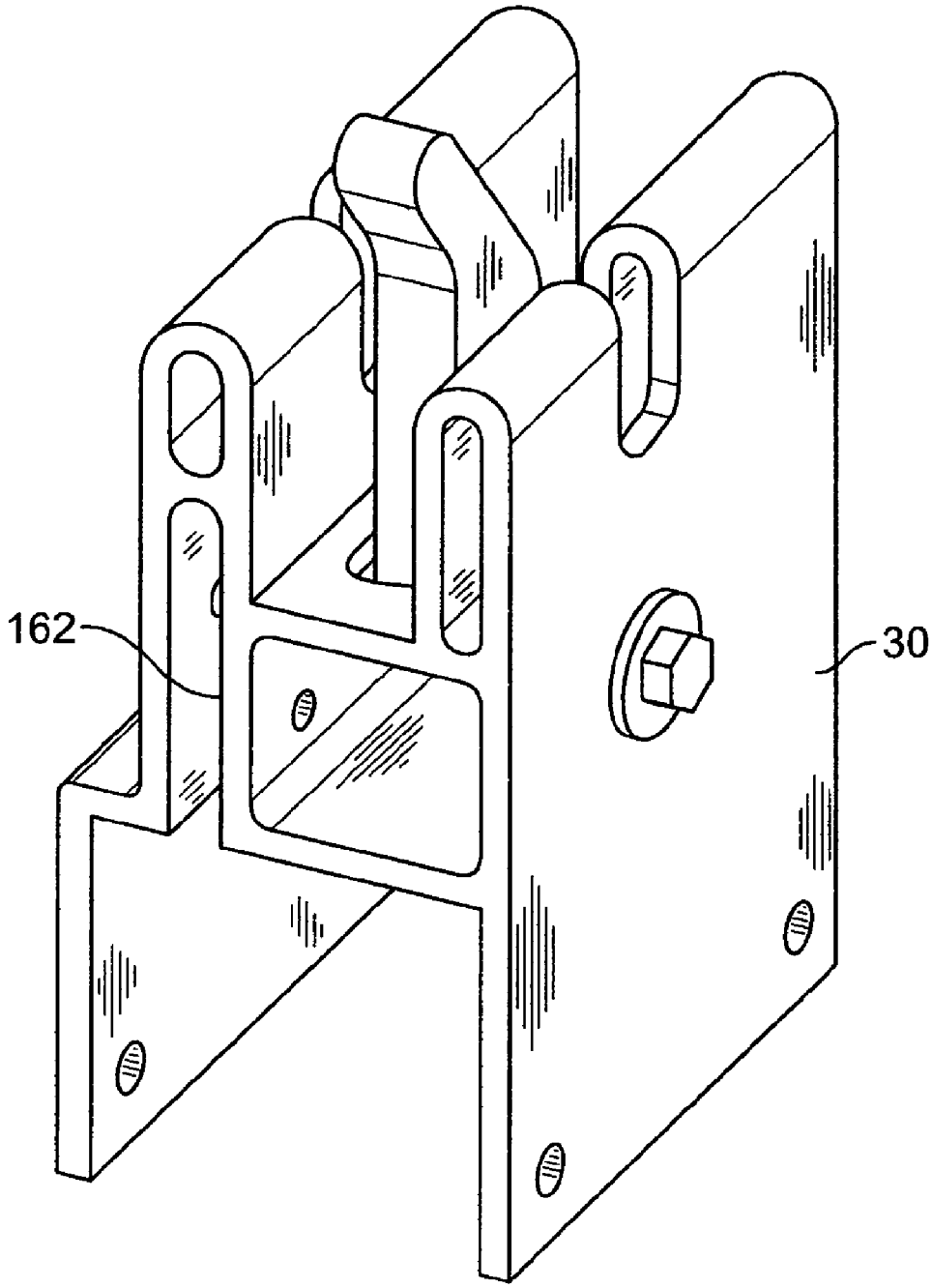
FIG. 20 is a perspective view of an upright including a spring loaded latch member of the latching mechanism.
Figure 27:
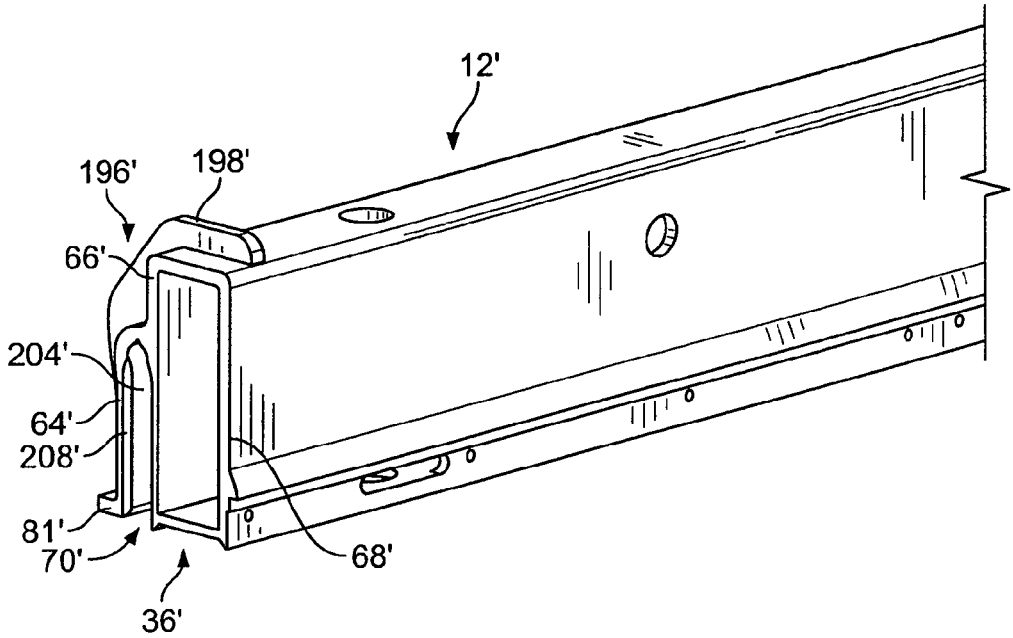
Figure 28:
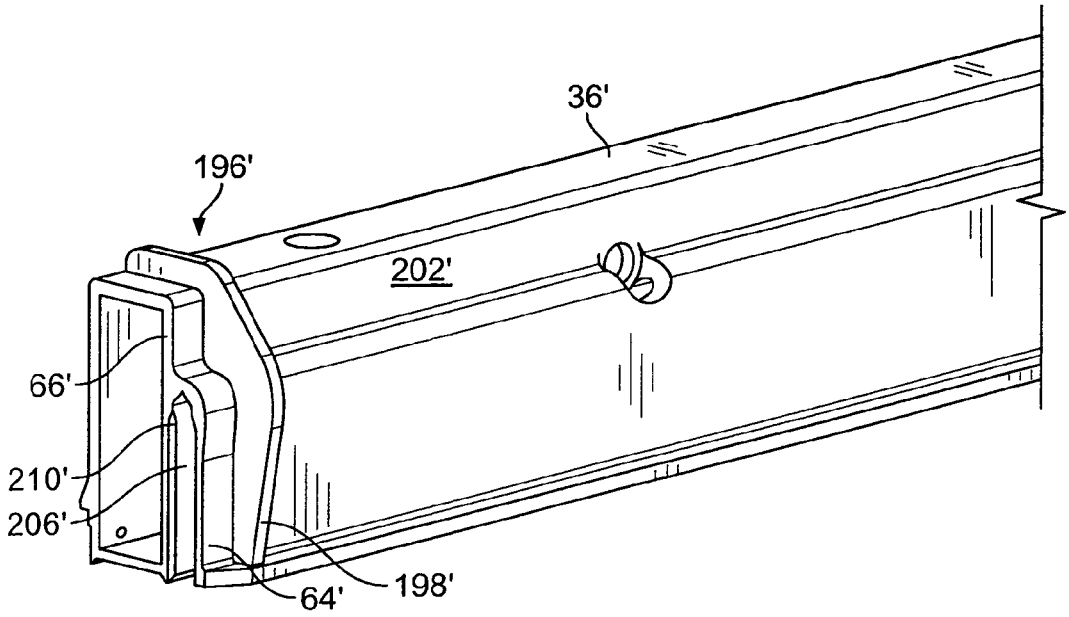
Figure 29:
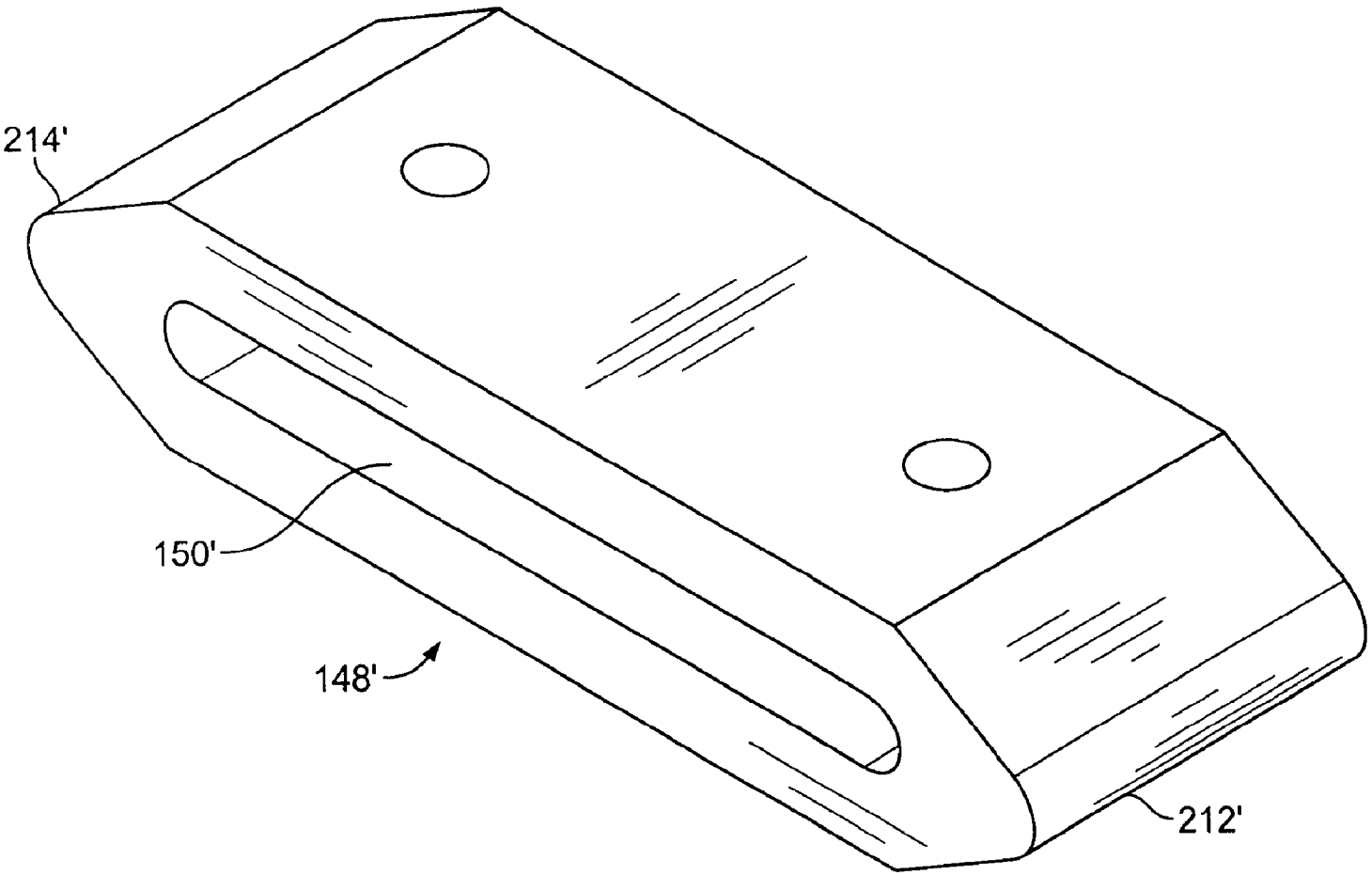

As previously discussed, the blade 18 has its upper cutting portion 18*a* extending through the slot 122 in the base member 14 and into the space 70 formed between the leg 64 and wall 66 of the clamping beam 12 with the clamping beam 12 latched to the belt cutting apparatus 10. Referring to FIG. 20, it can be seen that the end upright member 30 also includes an inverted U-shaped side chamber 162 that is aligned with the space 70 so that when the belt cutting apparatus 10 is not in use with the upper clamping beam 12 removed from the apparatus 10, the upper, sharp cutting portion 18*a* of the cutting blade 18 can be parked in the chamber 162 of upright member 30. As shown in FIGS. 27 and 28 with respect to apparatus 10', in the space 70' the inner surface 204' of the leg 64' and the facing surface portion 206' of the side wall 66' have inwardly tapered lead-in portions 208' and 210', respectively. These tapered surface portions 208' and 210' extend from the entry to the space 70' and are inwardly tapered toward each other so as to guide the upper blade guide 148' into the space 70' for driving of the blade 18' therein. As shown in FIG. 29, the upper blade guide 148' can also have tapered nose end portions 212' and 214' at either end thereof so that ends of the guide 148' are narrower than elongate central portion 216' thereof in which slot through opening 150' is formed. In this manner, depending on which one is leading, there tapered nose end portion 212' or 214' will cooperate with the lead-in surface portions 208' and 210' at the entry to the space 70' to smoothly guide the driven blade 48', and specifically the upper guide member 148' into the space 70', While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. A cutting apparatus for a conveyor belt, the cutting apparatus comprising:

an elongate upper clamp member for extending across the conveyor belt;

an elongate lower base member for extending across and below the conveyor belt to support the belt on the elongate lower base member;

a clamping mechanism for shifting the upper clamp member down and the lower base member relative to each other in a clamping direction toward each other for clamping the conveyor belt between the elongate upper clamp member and the elongate lower base member;

a cutting blade mounted to the lower base member for cutting the clamped conveyor belt;

a screw drive mechanism of the clamping mechanism operable to shift the upper clamp member and lower base member in the clamping direction for generating a clamping force on the conveyor belt;

an end linkage assembly including outboard and inboard pivot connections for pivotally connecting the lower base member, the screw drive mechanism, and the upper clamp member together; and a screw drive shaft of the screw drive mechanism between the outboard and the inboard pivot connections, wherein the end linkage assembly has an elongate pivot linkage extending between the outboard and the inboard pivot connections to pivotally connect the pivot linkage to both the lower base member and the upper clamp member with the elongate pivot linkage having a length and being pivotally connected to the screw drive shaft at an intermediate location along the length of the elongate pivot linkage.

2. The cutting apparatus of claim 1 wherein the screw drive shaft is mounted to the upper clamp member, and the screw drive mechanism includes a nut threaded on the screw drive shaft for travel along the screw drive shaft upon rotation of the screw drive shaft, the clamping mechanism being configured so that rotation of the screw shaft causes the nut to travel upwardly along the screw drive shaft with the upper clamp member shifting downward for clamping of the conveyor belt.

3. The cutting apparatus of claim 1 wherein the upper clamp member has opposite ends, the screw drive shaft is adjacent one of the ends and the inboard pivot connection is disposed inboard along the upper clamp member further away from the one end than the screw drive shaft.

4. The cutting apparatus of claim 1 wherein the elongate pivot linkage includes a link member having opposite ends with the link member pivotally connected to the screw drive mechanism intermediate the ends and one of the link member ends extending to the inboard pivot connection, and a latching mechanism mounted to the lower base member for releasably latching the other end of the link member to the lower base member.

5. The cutting apparatus of claim 1 wherein the cutting blade is mounted to the lower base member for travel along one side thereof so that the conveyor belt is only clamped adjacent one side of the cutting blade to allow the belt to peel away from the blade as the belt is cut.

6. The cutting apparatus of claim 1 wherein the upper clamp member comprises a clamp beam of a light weight metallic material.

7. A cutting apparatus for a conveyor belt, the cutting apparatus comprising:

an elongate upper clamp member for extending across the conveyor belt;

an elongate lower base member for extending across and below the conveyor belt to support the belt on the elongate lower base member;

a clamping mechanism for shifting the upper clamp member down and the lower base member relative to each other in a clamping direction toward each other for clamping the conveyor belt between the elongate upper clamp member and the elongate lower base member;

a cutting blade mounted to the lower base member for cutting the clamped conveyor belt;

a screw drive mechanism of the clamping mechanism operable to shift the upper clamp member and lower base member in the clamping direction for generating a clamping force on the conveyor belt;

an end linkage assembly including outboard and inboard pivot connections for pivotally connecting the lower base member, the screw drive mechanism, and the upper clamp member together; and a screw drive shaft of the screw drive mechanism between the outboard and the inboard pivot connections, wherein the upper clamp member has opposite ends, the screw drive shaft is adjacent one of the ends and the inboard pivot connection is disposed inboard along the upper clamp member further away from the one end than the screw drive shaft, the clamping mechanism comprises a pair of clamping mechanism, the screw drive mechanism comprises a pair of screw drive mechanisms each associated with one of the clamping mechanisms, the screw drive shaft comprises a pair of screw drive shafts each associated with one of the screw drive mechanisms and adjacent a corresponding one of the ends of the upper clamp member, the end linkage assembly comprises a pair of end linkage assembles, the inboard pivot connection comprises a pair of inboard pivot connections each associated with one of the end linkage assemblies, and the screw drive shaft comprises a pair of screw drive shafts each associated with one of the screw drive mechanisms, each of the inboard pivot connections being disposed inboard from an adjacent one of the screw drive shafts along the upper clamp member.

8. The cutting apparatus of claim 7 wherein the lower base member is upwardly bowed toward a center portion thereof to generally evenly distribute the clamping force lengthwise along the upper clamp member and the lower base member with the conveyor belt clamped between the upper clamp member and the lower base member.

9. A clamping apparatus for a conveyor belt, the clamping apparatus comprising:

an upper, elongate clamp member for extending across the conveyor belt;

a lower, elongate base member for extending across and below the conveyor belt to support the belt on the lower, elongate base member;

a screw shaft rotatably mounted to the upper clamp member to extend vertically relative to the upper clamp member;

a nut threaded on the screw shaft for travel along the screw shaft upon rotation of the screw shaft;

a pivot link pivotally connected to the nut;

a pivot anchor end of the pivot link for allowing the pivot link to be pivotally connected to the lower base member; and a pivotally fixed end of the pivot link pivotally connected to the upper clamp member and fixed against vertical translation relative to the upper clamp member, the pivot link being pivotally connected to the nut between the pivot anchor end and the pivotally fixed end so that travel of the upper clamp member downwardly to clamp the belt between the upper clamp member and the lower base member is amplified over upward travel of the nut along the screw shaft to provide for a rapid clamping operation with rotation of the screw shaft.

10. The clamping apparatus of claim 9 wherein the screw shaft and nut have cooperating threads and the pivot link has a predetermined length between the pivot anchor end and the pivotally fixed end with the nut at a predetermined distance between the pivot anchor end and the pivotally fixed end, and that are sized so that four rotations of the screw shaft generate approximately one inch of downward travel of the upper clamp member.

11. The clamping apparatus of claim 9 wherein the screw shaft has a predetermined number of threads per inch, and the same predetermined number of full turns of the screw shaft generates more than one inch of downward travel of the upper clamp member.

12. The clamping apparatus of claim 9 wherein the upper clamp member has opposite ends and a pivot shaft to which the pivotally fixed end of the pivot link is pivotally connected with the screw shaft being adjacent one of the upper clamp member ends and the pivot shaft being inboard along the upper clamp member from the screw shaft.

13. A clamping apparatus for a conveyor belt, the clamping apparatus comprising:

an upper, elongate clamp member for extending across the conveyor belt;

a lower, elongate base member for extending across and below the conveyor belt to support the belt on the lower, elongate base member;

a screw shaft rotatably mounted to the upper clamp member;

a nut threaded on the screw shaft for travel along the screw shaft upon rotation of the screw shaft;

a pivot link pivotally connected to the nut;

a pivot anchor end of the pivot link for allowing the pivot link to be pivotally connected to the lower base member; and a pivotally fixed end of the pivot link pivotally connected to the upper clamp member and fixed against vertical translation relative to the upper clamp member so that travel of the upper clamp member downwardly to clamp the belt between the upper clamp member and the lower base member is amplified over upward travel of the nut along the screw shaft to provide for a rapid clamping operation with rotation of the screw shaft, wherein the upper clamp member has opposite ends and a pivot shaft to which the pivotally fixed end of the pivot link is pivotally connected with the screw shaft being adjacent one of the upper clamp member ends and the pivot shaft being inboard along the upper clamp member from the screw shaft, and an end latching mechanism mounted to the lower base member having a biased latch member that is configured to cooperate with the pivot anchor end to allow the upper clamp member to be quickly latched to the lower base member for clamping a conveyor belt between the upper clamp member and the lower base member.

14. A clamping apparatus for a conveyor belt, the clamping apparatus comprising:

an upper, elongate clamp member for extending across the conveyor belt;

a lower, elongate base member for extending across and below the conveyor belt to support the belt on the lower, elongate base member;

a screw shaft rotatably mounted to the upper clamp member;

a nut threaded on the screw shaft for travel along the screw shaft upon rotation of the screw shaft;

a pivot link pivotally connected to the nut;

a pivot anchor end of the pivot link for allowing the pivot link to be pivotally connected to the lower base member; and a pivotally fixed end of the pivot link pivotally connected to the upper clamp member and fixed against vertical translation relative to the upper clamp member so that travel of the upper clamp member downwardly to clamp the belt between the upper clamp member and the lower base member is amplified over upward travel of the nut along the screw shaft to provide for a rapid clamping operation with rotation of the screw shaft, wherein the upper clamp member has opposite ends and a pivot shaft to which the pivotally fixed end of the pivot link is pivotally connected with the screw shaft being adjacent one of the upper clamp member ends and the pivot shaft being inboard along the upper clamp member from the screw shaft, and a cutting blade assembly mounted to the lower base member and having a cutting blade operable to travel along the lower base member for cutting the clamped conveyor belt.

* * * * *